US012194335B2

(12) United States Patent
Ellis

(10) Patent No.: US 12,194,335 B2
(45) Date of Patent: Jan. 14, 2025

(54) CRAWL SIMULATION EXERCISE AND STRETCHING MACHINE

(71) Applicant: Joseph K. Ellis, Ocala, FL (US)

(72) Inventor: Joseph K. Ellis, Ocala, FL (US)

( * ) Notice: Subject to any disclaimer, the term of this patent is extended or adjusted under 35 U.S.C. 154(b) by 0 days.

(21) Appl. No.: 18/046,958

(22) Filed: Oct. 17, 2022

(65) Prior Publication Data

US 2024/0123279 A1 Apr. 18, 2024

(51) Int. Cl.
*A63B 22/00* (2006.01)
*A63B 22/20* (2006.01)

(52) U.S. Cl.
CPC ..... *A63B 22/001* (2013.01); *A63B 22/203* (2013.01); *A63B 2022/0043* (2013.01); *A63B 2022/206* (2013.01); *A63B 2208/0295* (2013.01)

(58) Field of Classification Search
CPC ..... A63B 21/4045; A63B 2022/0043; A63B 2022/206; A63B 22/001; A63B 22/0087; A63B 22/20–201; A63B 23/0417; A63B 21/0051; A63B 21/012; A63B 22/203; A63B 23/1236; A63B 69/0062; A63B 2071/0072; A63B 2208/0295
See application file for complete search history.

(56) References Cited

U.S. PATENT DOCUMENTS

| | | | | |
|---|---|---|---|---|
| 2,825,563 | A | 3/1958 | Lawton | |
| 4,723,774 | A | 2/1988 | Monforte | |
| 5,277,681 | A | 1/1994 | Holt | |
| 6,361,476 | B1 | 3/2002 | Eschenbach | |
| 8,025,609 | B2 | 9/2011 | Giannelli | |
| 9,155,933 | B2 | 10/2015 | Ching-Yu | |
| 10,653,914 | B2 | 5/2020 | Ellis | |
| 11,524,206 | B2 * | 12/2022 | Ellis | A63B 21/4035 |
| 11,794,066 | B2 * | 10/2023 | Ellis | A63B 22/203 |
| 2010/0167878 | A1 | 7/2010 | Grind | |
| 2010/0167883 | A1 | 7/2010 | Grind | |
| 2015/0283425 | A1 | 10/2015 | Zhou | |
| 2016/0213970 | A1 | 7/2016 | Eschenbach | |
| 2018/0111019 | A1 * | 4/2018 | Ellis | A63B 22/0023 |

(Continued)

OTHER PUBLICATIONS

WIPO, International Search Report (in a corresponding application), Jan. 3, 2024.

*Primary Examiner* — Gary D Urbiel Goldner
(74) *Attorney, Agent, or Firm* — Laurence P. Colton; Smith Tempel Blaha LLC

(57) ABSTRACT

A crawling simulation exercise and stretching machine having left and right horizontally oriented curved tracks suspended between a forward support frame and a rearward support frame, left and right leg supports assemblies movably mounted on the curved tracks and each having a foot platform and shin pads for supporting a user's legs, left and right arm supports assemblies pivotally mounted on the forward support frame and each having a lever and handle for supporting a user's arms, a rocker arm assembly located central to the leg supports assemblies and the arm supports assemblies, and multiple linkage assemblies operably connecting the leg supports assemblies and the arm supports assemblies to the rocker arm assembly such that the leg supports assemblies and the arm supports assemblies cooperate to create a reciprocating arcing motion of the user's arms and legs to simulate a crawling exercise or stretching motion.

21 Claims, 24 Drawing Sheets

(56) References Cited

U.S. PATENT DOCUMENTS

| | | | | |
|---|---|---|---|---|
| 2020/0276471 | A1* | 9/2020 | Ellis | A63B 21/4034 |
| 2022/0111246 | A1 | 4/2022 | Ellis | |
| 2024/0042272 | A1* | 2/2024 | Ellis | A63B 21/4034 |

* cited by examiner

CRAWL SIMULATION EXERCISE AND STRETCHING MACHINE

BACKGROUND OF THE INVENTION

Technical Field

This invention relates to the general technical field of physical fitness, physical therapy and exercise equipment and machines. This invention relates more specifically to the field of exercise equipment for simulating a crawling exercise and stretching motion.

Prior Art

Exercise, physical fitness, and physical therapy equipment and machines are available in various configurations and for various purposes. In the exercise equipment field, there are generally three categories of products. One category of products known as strength or anaerobic training machines are geared more towards lower repetition, shorter duration, and higher resistance exercises. A second category of products commonly known as cardiovascular or aerobic training machines are generally geared towards longer duration, lower resistance, and higher repetition exercise. A third category of products are designed to allow a user to stretch their skeletal musculature. Stretching prior to exercising is proven to help prevent injuries. While each of these three categories of exercise equipment products are useful and effective, generally products that fit into one of these three categories are not very effective for the other two categories of exercise usage.

Strength training machines such as an arm curl or a leg press engage either the user's arms or legs but generally do not engage the user's arms and legs concurrently. These are reciprocating motions that generally only provide resistance in the push direction or the pull direction, but not both directions. These exercises can also be performed using free weights such as dumbbells and barbells. These motions are very effective at strengthening and building muscle, but are not as effective for calorie expenditure and cardiovascular conditioning.

Cardiovascular training machines such as treadmills and most exercise bikes generally engage the user's legs only. Other cardiovascular training machines such as elliptical trainers may include exercise handles to engage both the user's arms and legs concurrently; however, the leg portion of the exercise only allows one of the user's legs to engage in the first direction pushing motion while the other leg remains passive through second direction motion of the exercise.

Stretching machines generally move a portion of the user's body to a maximum or near maximum extended position to elongate and stretch certain muscles while the other portions of the user's body are restrained. Prior art stretching machines, however, do not offer concurrent and synchronized total body stretching wherein a user can move the arm and leg on the same side of their body to maximum or near maximum lengths apart while pulling the arm and leg on the other side of their body to maximum or near maximum proximity, all while their body is being held in a mostly prone position. Machines that offer a similar motion are constrained by a complete loop circular or elliptical pattern of motion of the user's arms or legs or both the user's arms and legs. These complete loop circular or elliptical patterns of motion machines require that a user follow the continuous complete loop pattern of the motion of the machine and do not allow the user to control the length of extension of the arm or leg motions. These complete loop circular or elliptical patterns of motion machines are designed for continuous repetition exercises and therefore place the user in a position that comfortably allows them to complete the motion pattern without extended stretching. Therefore, these machines are not effective as stretching machines.

Many machines have been developed that engage a user's upper and lower body into an exercise motion, but each of these previous machines have deficiencies as previously described herein. U.S. Pat. No. 6,361,476 of Eschenbach discloses an "Elliptical Exercise Striding Machine" with individual left and right foot pedals, each movably mounted to and dependently connected by an adjustable rotational crank arm assembly proximal to a first end and supported by either a rolling wheel or pivoting handle linkage proximal to a second end. During operation of the machine, the foot pedals move dependently in a rotating ellipse with a closed loop range of motion and can be adjusted in stride length and the shape or motion pattern of the elliptical motion can be adjusted. The left-side foot pedals and handles and right-side foot pedals and handles are dependently connected in opposing positions of the range of motion and move in unison. This complete loop range of motion of the elliptical pattern requires the user to follow the machines complete range of motion requiring the range of motion to be adjustable to fit various size users with various capabilities adding additional components and wear components to the cost of the machine. This complete loop pattern of motion also prevents the user from controlling the range of motion of the machine simply by moving their arms and legs in longer or shorter paths of motion.

U.S. Pat. No. 8,025,609 of Giannelli et al. discloses a "Striding Exercise Machine" comprising a pair of pivotally supported individual foot pedals that are dependently linked together through a rotational crank assembly and move in unison in a back and forth fixed range of motion arcuate path with the arcuate path being adjustable to a selected segment. The apparatus includes handles or arms interconnected or interlinked to the foot pedals for upper body pushing or pulling energy input. The handles or arms pivot together with and in the same back and forth direction as the pedals to which they are interlinked and the left-side pedals and arms are in an opposing position of the range of motion as the right said pedals and arms. The range of motion of the pedals and handles or arms are controlled by a circular rotating crank linkage assembly. Although the motion pattern of the pedals is a reciprocating arcing motion, the range of this pattern of motion is controlled by the machine. This complete loop pattern of motion of the machine's linkage assembly prevents the user from controlling the range of motion of the machine simply by moving their arms and legs in longer or shorter paths of motion.

US Patent Application Publication No. 2015/0283425 of Zhou discloses an "Elliptical Prone Exerciser" machine. This machine utilizes a front drive crank connected to the hand supports and a separate rear drive crank connected to the knee supports such that a user is required to follow a full complete looped path of motion with their arms and legs for each repetition. These complete loop patterns of motion prevent the user from controlling the range of motion of the machine simply by moving their arms and legs in longer or shorter paths of motion. This complete loop elliptical path of motion of the user's arms and legs also prevents the Zhou machines from being operated as a stretching device as previously described. Moreover, Zhou teaches a machine that requires the output ends of both the front drive cranks and the rear drive cranks to be connected with a dampening wheel and the dampening wheel creates the resistance to the exercise motion. Therefore, the Zhou machine will not operate without a dampening wheel resistance system as indicated in claim 1, which requires that the output ends of both the front drive mechanism and the rear drive mechanism are connected with the damping wheel The Zhou specification states that the frame is provided with a damper regulator to control the damping wheel and that the damping wheel ensures a smoother and more coordinated motion and is capable of adjusting motion strength. Therefore, not only will the Zhou machine not operate without a damping wheel, but this type of mechanism also limits the type of resistance mechanism that can be used to create resistance to the exercise motion of the Zhou machine as stated in claim 16, which requires that the damping wheel is an inertial wheel or a magnetic-control wheel. In each and every embodiment of the Zhou machine the hand support front drive system and the knee support rear drive system are connected a pair of rotating drive cranks and these front and rear rotating drive cranks are connected with a rotating wheel such that the function of each and every embodiment of the Zhou machine is limited by these complete loop rotating mechanisms as described herein.

U.S. Pat. No. 9,155,933 of Ching-Yu discloses a "High Knees Exercise" machine that places the user in a seated position for an exercise engagement of a user's legs only. A seat base is disposed on a first supporting base. Left and right drive mechanisms are connected to the first supporting base and pivoting members are supported by pivoting members below the seat and positioned on either side of the seat to swing forward of the seat. Pedals are connected to the swinging ends of the left and right drive members. A linkage mechanism connects the left and right drive members for leading the drive members in opposing motion relative to each another. While this machine allows the user to control the range of motion of the exercise motion provided by the machine, the swinging pendulum motion of the single left side drive member, and the single right side drive member create a very tight radius path of exercise motion of pedals. This tight radius is created because the length of the drive members has to accommodate the average leg length of a user. This tight radius creates an unnatural and very challenging exercise motion for most users, especially in a seated position. Also, according to the only independent claim, which is claim 1, the Ching-Yu machine requires a seat and a magnetic resistance device to operate. Claim 1 line 7 requires a seat base disposed on the first supporting base. Claim 1, lines 28-30 requires two magnetic resistance devices for providing magnetic resistances in accordance with slides of the two driving members respectively. This limits the function of the Ching-Yu machine and limits how the exercise motion can be resisted to provide exercise regiments of varying degrees of difficulty.

U.S. Pat. No. 5,277,681 of Holt discloses a "Stretching Exercise Machine" that places a user in a variety of prone, supine, seated, and standing positions. In each of these positions, a portion of the user's body is restrained while other portions of the user's body are moved to extended positions to create the muscular stretching. Each position requires substantial adjustment to the machine and in many positions requires a second person to apply the restraints to the user. Getting in and out of these various positions and performing the stretching exercises is very time consuming. Moreover, not allowing the user's entire body to move limits the amount of muscles that can be stretched in a single position.

This applicant has previously disclosed exercise machine inventions in U.S. Pat. No. 10,653,914, US Patent Application Publication No. 2020/0276471, and US Patent Application Publication No. 2022/0111246. Some embodiments of these previously disclosed machines comprise a stationary base frame and a separate user support frame that is pivotally connected to the stationary base frame and adjustable in angle relative to the stationary base frame with an angle adjusting device. Other embodiments of the these previously disclosed machines comprise a user support that is pivotally engaged with the floor surface and adjustable in angle relative to the floor surface with an angle adjusting device. Each of these embodiments comprise pivoting upper body user supports with gripping handles and lower body user supports with foot plates and shin support pads that roll on arcing tracks. These upper body user supports and lower body user supports are operatively connected with a rocker arm assembly so that the upper body user supports and lower body user supports operate in unison to create a total body pushing and pulling exercise with the user's arms and legs. Of the multiple exercise positions these previous embodiments can create, the more horizontal user support position that simulates a crawling exercise places the user in an exceptional position to be able to leverage their entire body into the exercise motion. This position combined with the shin support pads also places the user in a mostly gravity neutral position to allow the user to extend and contract each side of their body to perform a stretching exercise or a cardiovascular exercise or a strength exercise or a combination of these exercises, without the assistance or hindrance of gravity.

Therefore, a stationary position machine that places the user in a shin-supported crawl position wherein the user's hands engage a set of arcing motion pivoting levers and the user's feet engage a set of rolling foot platforms that move in an arcing motion and the exercise motion of the user's leg and arms are synchronized with a rocker arm and linkage assembly would be a significant improvement to the art. A stationary single frame incorporating the user support and all the mechanical components of the machine would greatly reduce the amount of components of the machine and therefore substantially reduce cost, maintenance, and wear items while increasing durability. This improvement would also reduce the overall size and weight of the machine to save space in a user's home or exercise facility. The size and weight reduction would also reduce shipping cost. The reduction in mechanical components would also reduce the time and complexity of assembling the machine. This improvement would also allow the machine to be constructed with a lower point of entry and exit making it easier and safer to mount and dismount the machine with the use of assistance steps. For users that prefer to exercise and or stretch their legs only, a further reduction of components, weight, and cost can include eliminating the pivoting upper body supports with gripping handles and replacing them with a stationary grip or grips.

An exercise machine that would greatly improve the efficiency and effectiveness of a workout regimen would concurrently engage the user's upper and lower body providing a natural and bio-mechanically correct reciprocating arcing motion wherein one arm pushes while the other arm pulls and one leg pushes while the other leg pulls to engage the maximum amount of skeletal musculature including the user's core into a single exercise or stretching motion. Such an improved machine would also allow the user's exercise or stretching motion to control the range of motion of the mechanical motion created by the exercise machine such that various size users could operate the machine comfortably without requiring any adjustments to the machine. Such an improved machine that places the user in a gravity neutral crawling position will more evenly distribute the user's weight between all four limbs, prevent gravity from assisting or hindering the exercise or stretching motion, place the user in a position of maximum power output, and minimize the chance of injury. Moreover, if the mechanical features of such an improved exercise machine would allow the machine to operate with or without a resistance mechanism, the machine could be utilized as a skeletal muscular stretching apparatus or a strength training machine or a cardiovascular training machine or a combination of stretching or cardiovascular training or strength training. The present invention provides just such an improved exercise machine as is further described herein.

BRIEF SUMMARY OF THE INVENTION

The present invention teaches a crawl position exercising and stretching machine. In a first embodiment, the machine is supported by a rear support frame and forward support frame. The first ends of a set of left and right arc shaped wheel tracks are mounted on the rear support frame and the second end of the arc shaped wheel tracks are mounted on the forward support frame such that the arc shaped wheel tracks are suspended in a horizontal orientation between the rear support frame and the forward support frame. Left and right wheel carriages are rollably mounted on the left and right arc shaped wheel tracks. The first ends of left and right levers that support the user's arms are pivotally mounted on the forward support frame and the second end of the left and right levers comprise at least one handle and the left and right arm levers are mounted in a vertical orientation. Left and right linkages connection hubs are mounted on the forward frame. A rocker arm with left and right ends and a center axle is pivotally mounted on the forward support frame. First and second left linkage bars connect the left wheel carriage with the left linkages connection hub and first and second right linkage bars connect the right wheel carriage with the right linkages connection hub. A left foot platform and shin pad are connected with the first left linkage bar at a location adjacent to the left wheel carriage. A right foot platform and shin pad are connected with the first right linkage bar at a location adjacent to the right wheel carriage. A third left linkage bar connects the left linkages connection hub with the left end of the rocker arm and a third right linkage bar connects the right linkages connection hub with the right end of the rocker arm. A fourth left linkage bar connects the left lever with the left linkages connection hub and a fourth right linkage bar connects the right arm lever with the right linkages connection hub.

During operation of this embodiment of the machine, the left foot platform and shin pad move in the opposite direction of the right foot platform and shin support pad, and the left lever and handle move in the opposite direction of the right lever and handle. The left side foot platform and shin pad, the right side foot platform and shin pad, the left lever and handle, and the right lever and handle all move in arcing reciprocating motions. The motions of left side foot platform and shin pad, the right side foot platform and shin pad, the left lever and handle, and the right lever and handle always move concurrently and the motions are synchronized by the motion of the rocker arm. This embodiment of the invention can be operated without a resistance mechanism or with a resistance mechanism to resist the motion of the left side foot platform and shin pad, the right side foot platform and shin pad, the left lever and handle, and the right lever and handle. The resistance mechanisms can include at least one of but are not limited to magnetic resistance, friction resistance, air displacement resistance, fluid displacement resistance, spring tension resistance, or a combination thereof.

In a second embodiment of the invention, the components of the machine cooperate and function as in the first embodiment with the exception that the left and right levers and handles are not pivotally mounted on the forward frame support but are operatively connected to the left and right linkages connection hubs and the fourth left and right linkage bars are removed. This embodiment of the invention can be operated without a resistance mechanism or with a resistance mechanism to resist the motion of the left side foot platform and shin pad, the right side foot platform and shin pad, the left lever and handle, and the right lever and handle. The resistance mechanisms can include one of but are not limited to magnetic resistance, contact friction resistance, air displacement resistance, fluid displacement resistance, spring tension resistance, or a combination thereof.

In a third embodiment of the invention, the components of the machine cooperate and function as in the first embodiment with the exception that the left and right levers and handles are removed and the left and right fourth linkage bars are removed. A handle support and left and right stationary handles are mounted on the rocker arm support tube. In this embodiment, the machine operates as a legs engagement only crawling simulation exercise and stretching machine while the user grips and braces against the stationary handle. This embodiment of the invention can be operated without a resistance mechanism or with a resistance mechanism to resist the motion of the left side foot platform and shin pad, and the right side foot platform and shin pad. The resistance mechanisms can include one of but are not limited to magnetic resistance, contact friction resistance, air displacement resistance, fluid displacement resistance, spring tension resistance, or a combination thereof.

BRIEF DESCRIPTION OF THE DRAWINGS

In some figures, the invention is illustrated from one side and in these figures the invention looks the same, but in a general mirror image from the opposite side, with both sides having similar structures, features, and components. In some figures certain components have been removed or are illustrated as transparent such that the view of other components is not obstructed.

DETAILED DESCRIPTION OF PREFERRED EMBODIMENTS

Figure 1:
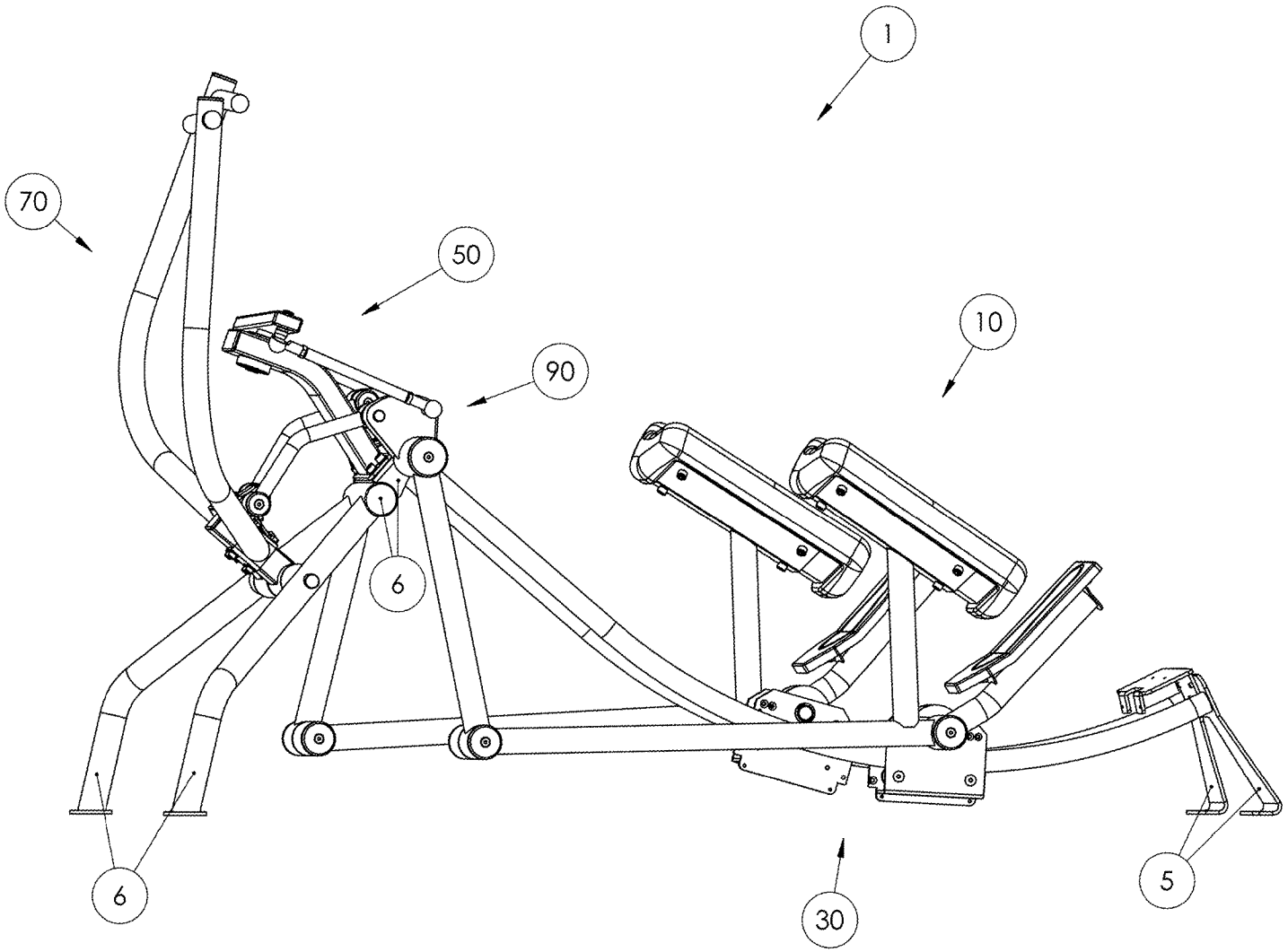
FIG. 1 is a left side perspective view of a first embodiment of the invention.

Exemplary preferred embodiments are disclosed below in connection with the attached drawings. Throughout this specification, various terms will be used to describe various elements or sets of elements, features or sets of features, mechanisms, and devices. For example, the term "rearward end or portion of the machine" will refer to the end or portion of the machine most near the foot platforms and distal to the handles. The term "forward end or portion of the machine" will refer to the end or portion of the machine most near the handles and distal to the foot platforms. The term "pivot" will refer to any combination of an axle, one or more bushings or bearings housings, or other rotational components in which another component or set of components rotate upon. The term "assembly" will refer to a group of components that cooperate together to create a function of the invention.

The invention is comprised of many identical left and right components as illustrated in various perspective views and many of these components will frequently be referred to and described in a plural context so as to prevent the duplication of descriptions of identical left and right components. Many of these components will have the same identification number and will frequently be referred to as a left or right component. A "left" or "left side" component or set of components will refer to those that would be on the user's left side of the machine when the user is mounted on the machine and a "right" or "right side" component or set of components will refer to those that would be on the user's right side of the machine when the user is mounted on the machine. Descriptions of components or sets of components that are identified once as being identical on the left and right side of the machine may be referred to in a singular dialogue to prevent excessive duplication of description, but it is to be understood that the description or terminology of a left component or set of components applies to the right counterpart component or set of components and vice versa unless expressly stated otherwise. Also, it is to be understood that when components or sets of components that have been identified at least once as being duplicates on the left and right sides of the machine are described as cooperating with or being connected to other components or sets of components that have been identified at least once as being duplicates on the left and right sides of the machine, that left side components or sets of components will cooperate with or connect to left side components and right side components or sets of components with cooperate with or connect to right side components.

The term "horizontally oriented" will refer to a component or set of components on the machine that is more parallel to the floor surface than perpendicular to the floor surface during operation of the machine or while stationary. The term "vertically oriented" will refer to a component or set of components on the machine that is more perpendicular to the floor surface than parallel to the floor surface during operation of the machine or while stationary. The term "hub" will refer to a rotatable component that connects multiple functional components of the machine.

There are three embodiments of the invention; however, each of the embodiments has many components and assemblies that are common to all three embodiments and these common components and assembly function identically or nearly identical on each of the three embodiments. These common components will be identified with like or similar numbers and to prevent unnecessary duplication the description of the structure, configuration, and function of these components and assemblies may only be described once with references to previous descriptions for other embodiments to prevent excessive duplication of description.

To further comply with written description and enablement requirements, the following patents and patent application publications are also incorporated herein by this reference in their entirety. U.S. Pat. Nos. 9,155,933, 10,065,062, 10,994,169, US Patent Application Publication No. 2015/0283425, and U.S. Pat. No. 8,025,609.

FIGS. 1-24 are all views of embodiments of the invention this inventor refers to as "A crawling simulation exercise and stretching machine". Generally, the invention is a machine that places the user in a mostly prone facing angled position while exercising or stretching. In certain embodiments the user's arms move in forward and rearward reciprocating arcing motions while the user's legs concurrently movement in forward and rearward reciprocating arcing motions. While performing this exercise or stretching motion, the user's left arm and left leg move in opposite directions from each other, and the user's right arm and right leg move in opposite directions from each other. During this exercise motion while one arm is pushing the other arm is pulling and while one leg is pushing the other leg is pulling.

These exercise motions of the user's arms and legs are synchronized such that the user's arms and legs move in unison.

In other embodiments of the invention the user's arms are supported by a stationary grip while the user's legs concurrently movement in forward and rearward reciprocating arcing motions. During these exercise motions, the user's left leg and the user's right leg move in opposite directions from each other. During these exercise motions while one leg is pushing, the other leg is pulling. These exercise motions of the user's left leg and the user's right leg are synchronized such that the user's left leg and the user's right leg move in unison.

All of the exercise motion components of the machine are mounted on a forward support frame and a rearward support frame. In all embodiments, the machine does not require a resistance mechanism such that it can be operated to performing stretching exercises, physical therapy, and light cardiovascular exercises. In all embodiments, the machine may comprise a resistance mechanism for performing higher exertion cardiovascular exercises and or strength exercises.

FIGS. 1-24, illustrate various views of the embodiments of the machine 1, machine 100 and machine 200 to provide a more complete understanding of the invention. FIGS. 1-4 illustrate the support structure and functional components of the first embodiment, machine 1. FIGS. 5-14 illustrate the support structure and functional components of machine 1 coupled with various resistance mechanisms. FIG. 15 illustrates the support structure and functional components of a second embodiment of the machine, machine 100. FIGS. 16-19 illustrate the support structure and functional components of machine 100 coupled with various resistance mechanisms. FIG. 20 illustrates the support structure and functional components of a third embodiment of the machine, machine 200. FIGS. 21-24 illustrate the support structure and functional components of machine 200 coupled with various resistance mechanisms.

Now referring to FIGS. 1-4, as illustrated in FIG. 1, a rear support frame 5 supports the rearward portion of machine 1 and a forward support frame 6 supports the forward portion of machine 1. A wheel carriages assembly 30 is suspended between the rear support frame 5 and the forward support frame 6. A leg supports assembly 10 is mounted on the wheel carriages assembly 30. An arm supports assembly 70 is mounted on a forward portion of the forward support frame 6. A linkages connection hubs assembly 90 is mounted on a rearward portion of the forward support frame 6. A rocker arm assembly 50 is mounted on a central portion of the forward support frame 6.

Figure 2:
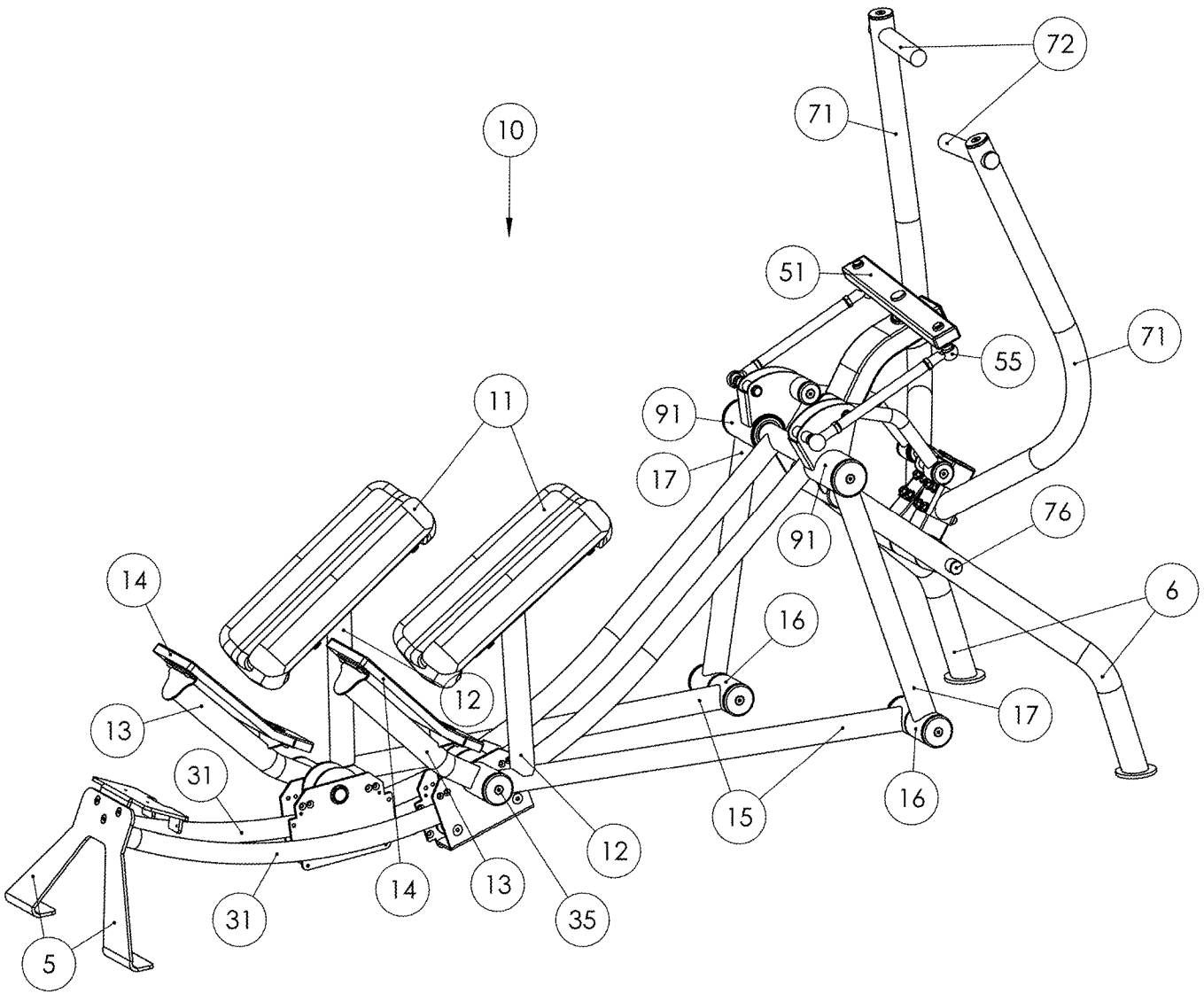
FIG. 2 is a right side perspective view of the first embodiment of the invention.

As illustrate in FIG. 2, rear support frame 5 is represented as being constructed of formed sheet metal but can be made of any suitable material and shape capable of supporting the components on the rearward portion of machine 1. Forward support frame 6 is represented as constructed of round metal tubes but can be made of any suitable material and shape capable of supporting the components of the forward portion of machine 1.

Figure 4:
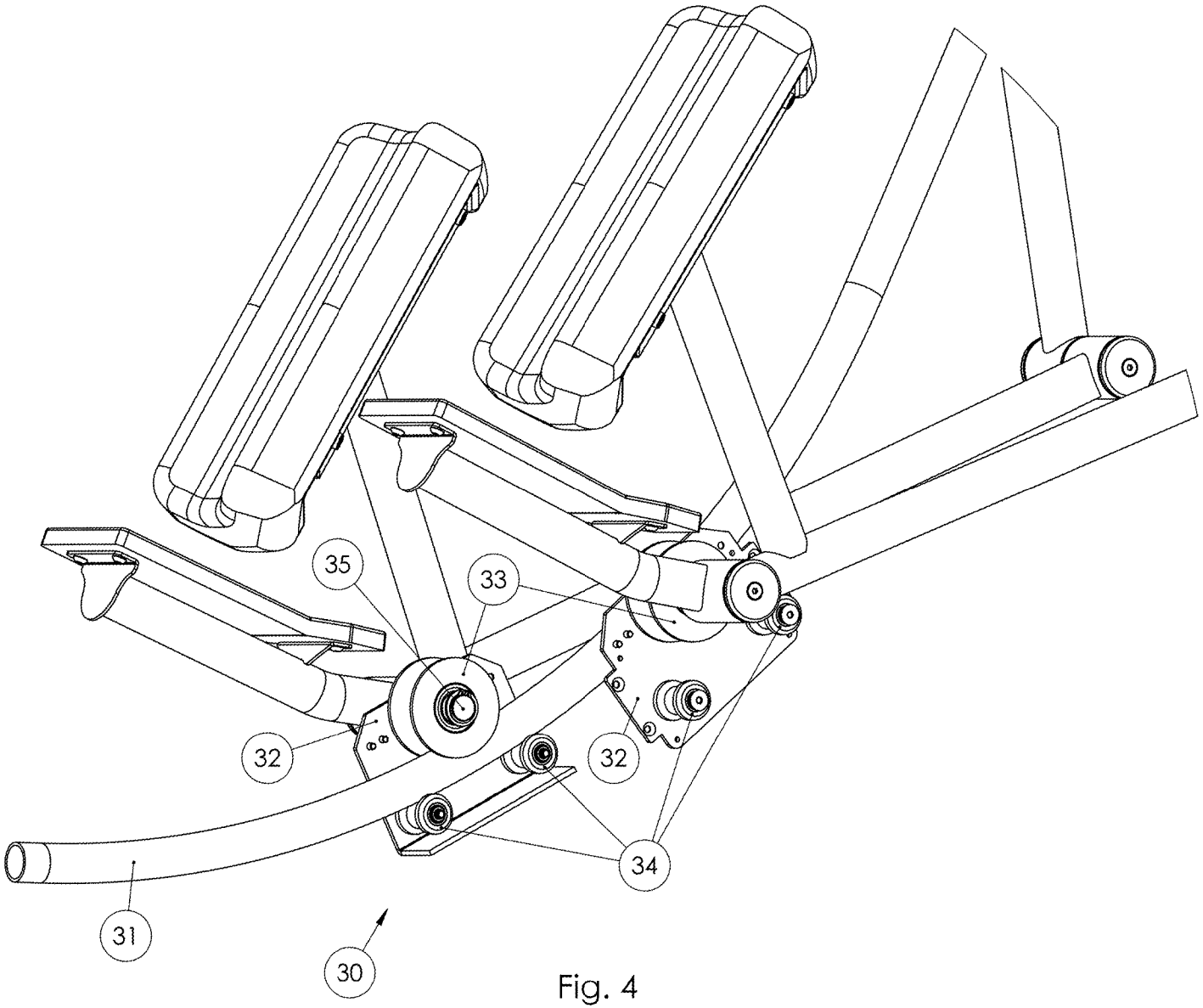
FIG. 4 is an isolated view of components of the first embodiment of the invention.

As best illustrated in FIGS. 2 and 4, wheel carriages assembly 30 is comprised of left and right wheel carriage tracks 31, each having a first end and a second end. The first ends of left and right wheel carriage tracks 31 are rigidly connected to rear support frame 5 and the second ends of left and right wheel carriage tracks 31 are rigidly connected to forward support frame 6. Wheel carriage tracks 31 are curved shaped tubes that allow wheel carriage assembly 30 to move along wheel carriage tracks 31 in an arcing motion. Left and right wheel carriage housings 32 are generally "U" shaped structures that each house one upper carriage wheel 33 and two lower carriage wheels 34. Upper carriage wheels 33 bear the weight of wheel carriage assemblies 30 and a portion of the weight of a user U as upper carriage wheels 33 rotate on upper carriage wheel axle 35 to roll along the upper portion of wheel carriage tracks 31. Lower wheel carriage wheels 34 move along the lower portion of wheel carriage tracks 31 to guide the alignment of wheel carriage housings 32 as wheel carriage housings 32 move along wheel carriage tracks 31.

As best illustrated in FIG. 2, leg supports assembly 10 are pivotally connected to wheel carriage assemblies 30 with left and right upper wheel carriage axles 35. Upper wheel carriage axles 35 extend outward in a perpendicular direction from left and right wheel carriage housings 32 such that the outward portion of upper wheel carriage axles 35 is outward of and perpendicular to wheel carriage tracks 31. A first end of left and right foot platform support tubes 13 are rigidly connected at a perpendicular angle to the rearward side of the outward portions of left and right upper wheel carriage axles 35, respectively, and the second end of foot platform support tubes 13 extend rearward at an upward angle away from upper wheel carriage axles 35. Rectangular shaped left and right foot platforms 14 are rigidly mounted along the upper side of left and right foot platform support tubes 13, respectively, and cover most of the length of foot platform support tubes 13.

First ends of left and right first leg support linkage bars 15 is rigidly connected to a forward side of left and right upper wheel carriage axles 35, respectively, and the second end of first leg support linkage bars 15 extends forward of upper wheel carriage axles 35 such that first leg support linkage bars 15 are mostly parallel to the floor surface. A first end of left and right shin pad support tubes 12 is rigidly connected proximal to the first end of first left and right leg support linkage bars 15 respectively, and the second end of shin pad support tubes 12 extends upward from first leg support linkage bars 15 at a slight angle off of perpendicular.

A central portion of rectangular shaped left and right shin pads 11 is rigidly connected to the second ends of left and right shin pads support tubes 12, respectively, such that shin pads 11 are in line with wheel carriage tracks 31 wherein the first narrower ends of shin pads 11 are more proximal to the rearward end of machine 1 and the second narrower ends of shin pads 11 are more proximal to the forward end of machine 1. The upper side of shin support pads 11 are represented as a concave shape so as to comfortably and securely support user's U legs during operation of machine 1.

The second ends of left and right first leg support linkage bars 15 are pivotally connected to the first ends of left and right second leg support linkage bars 17, respectively, with left and right leg support linkage bar pivots 16, respectively. The left and right second ends of second leg support linkage bars 17 are rigidly connected to the lower portion of left and right linkage connection hubs pivots 91, respectively. Second leg support linkage bars 17 are mostly oriented at a perpendicular angle to first leg support linkage bars 15 when wheel carriage assembly 30 is proximal to a central portion of carriage wheel tracks 31 and second leg support linkage bars 17 move to various degrees of angle relative to first leg support linkage bars 15 as wheel carriage assembly 30 moves towards the forward and rearward ends of wheel carriage tracks 31.

Figure 3:
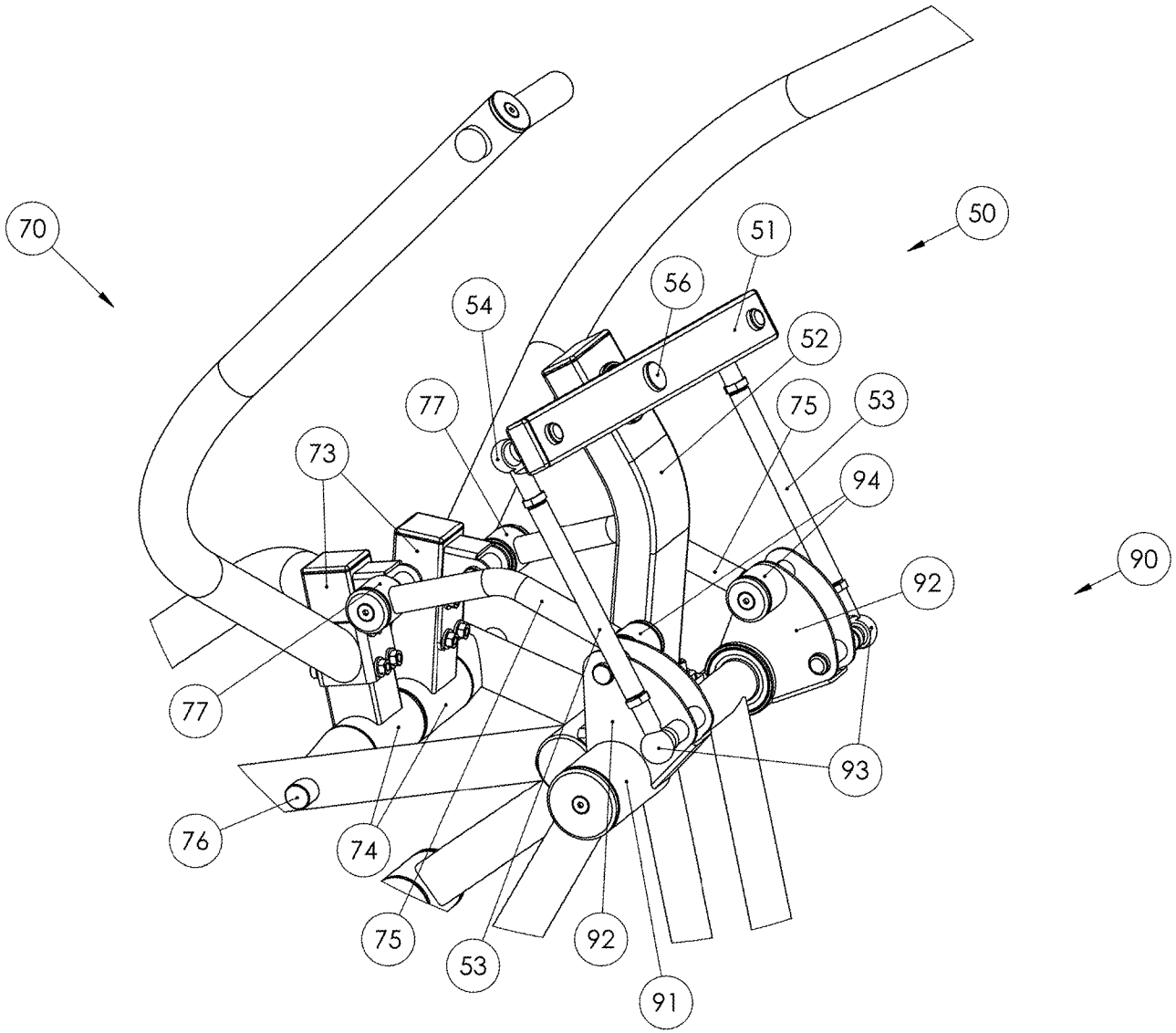
FIG. 3 is an isolated view of components of the first embodiment of the invention.

As best illustrated in FIGS. 2 and 3, linkages connection hubs assembly 90 is comprised of independently pivotable left and right linkages connection hub pivots 91 that are mounted to the forward support frame proximal to and perpendicular of the second ends of left and right wheel carriage tracks 31, respectively. Linkages connection hub pivots 91 are elongated rotatable cylinders. Left and right linkages connection hub flanges 92 are rigidly mounted to the upper sides of left and right linkages connection hub pivots 91, respectively, and on the inner portion of linkages connection hub pivots 91 more proximal to wheel carriage tracks 31. Linkages connection hub flanges 92 are represented as formed sheet metal parts but can be constructed of any shape and material capable of connecting at least one pivoting linkage bar to linkages connect hub pivots 91. Left and right linkages connection hub flange rear pivots 93 are rigidly mounted on the rearward portion of left and right linkages connect hub flanges 92, respectively. Left and right linkages connection hub flange forward pivots 94 are rigidly mounted on the forward portion of left and right linkages connect hub flanges 92, respectively.

As best illustrated in FIGS. 2 and 3, arm supports assembly 70 is comprised of a lever pivot axle 76 that is rigidly connected to forward support frame 6 and independently pivoting left and right lever pivots 74 are mounted on lever pivot axle 76. First ends of elongated left and right lever mounting tubes 73 are rigidly connected to an upper portion of left and right lever pivots 74, respectively, and the first ends of left and right levers 71 are rigidly connected to a central portion of left and right lever mounting tubes 73, respectively. Left and right handles 72 are rigidly connected to the second ends of left and right levers 71, respectively. Left and right lever linkage bar pivots 77 are connected to the second ends of left and right lever mount tubes 73, respectively. The first ends of left and right lever linkage bars 75 are pivotally connected to left and right lever linkage bar pivots 77, respectively, and the second ends of left and right lever linkage bars 75 are pivotally connected to left and right linkages connection hub flange forward pivots 94, respectively.

As best illustrated in FIGS. 2 and 3, rocker arm assembly 50 is comprised of the following components. The first end of a rocker arm support tube 52 is mounted on the center longitudinal line of machine 1 at a location on forward support frame 6 that is central of arm supports assembly 70 and linkages connection hub assembly 90. Rocker arm support tube 52 extends upwardly at a forward angle and a central portion of a rocker arm 51 is pivotally mounted on the second end of rocker arm support tube 52 with a rocker arm pivot axle 56. Rocker arm pivot axle 56 is rigidly connected to the central portion of rocker arm 51. A rocker arm left end linkage pivot 54 is connected proximal to the left end of rocker arm 51 and a rocker arm right end linkage pivot 55 is connected proximal to the right end of rocker arm 51. The first end of a left side rocker arm linkage bar 53 is pivotally connected to rocker arm left end linkage pivot 54 and the second end of the left side rocker arm linkage bar 53 is pivotally connected to the left side linkages connection hub forward pivot 94. The first end of a right side rocker arm linkage bar 53 is pivotally connected to rocker arm right end linkage pivot 55 and the second end of the right side rocker arm linkage bar 53 is pivotally connected to the right side linkages connection hub forward pivot 94.

Figure 5:
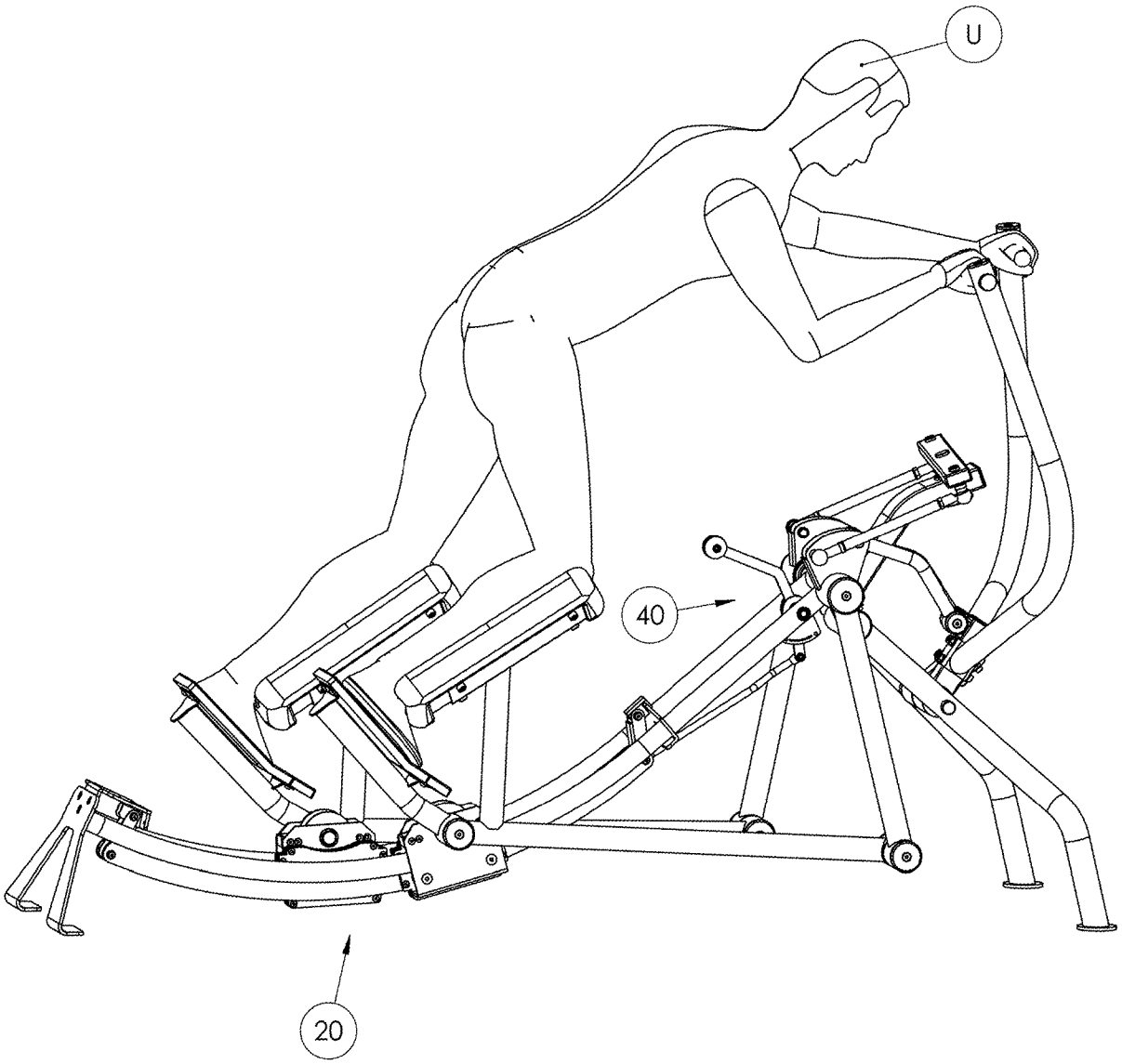
FIG. 5 is a right side perspective view of the first embodiment of the invention with a magnetic resistance mechanism and a user mounted on the machine.

As illustrated in FIG. 5, to operate machine 1, a user U would mount machine 1 by placing the bottoms of user's U feet on foot platforms 14 while resting user's U shins, ankles, and the tops of user's U feet against shin pads 11. User U would also grasp handles 72. User U will then begin the exercise motion by urging the left handle 72 in the opposite direction of right handle 72 while concurrently urging the left foot platform 14 and left shin pads 11 in the opposite direction of the right foot platform 14 and right shin pad 11. For example, in a first direction, if user U urges left handle 72 forward in a pushing motion, user U would be urging left foot platform 14 and left shin pad 11 rearward in a pushing motion, and concurrently user U would be urging right handle 72 rearward in a pulling direction and urge right foot platform 14 and shin pad 11 forward in a pulling motion. When user U reaches the desire range of motion in the first direction, then user U at user's U sole discretion and not caused by the mechanical features of the machine, would reverse the motions to a second direction so as to urge left handle 72 rearward in a pulling motion, and urge left foot platform 14 and left shin pad 11 forward in a pulling motion, while concurrently urging right handle 72 forward in a pushing direction and urging right foot platform 14 and shin pad 11 rearward in a pushing motion. During the pushing motions, the bottoms of user's U feet engage and push against foot platforms 14 while the user's U legs are support by shin pads 11. During the pulling motions, the bottom of user's U feet are supported by foot platforms 14 while user U pulls against shin pads 11 with user's U ankles and the tops of user's U feet. In other words, the unique configuration of machine 1 allows user's U feet and ankles to be wedged in between foot platforms 14 and shin pads 11 to allow user U to engage all of the muscle groups of user's U legs, hips, and buttocks in a first pushing motion and a second pulling motion to achieve maximum exercise efficiency.

During operation in a first direction motion of the left side components of machine 1, when left foot flatform 14 and shin pad 11 move rearward, left wheel carriage assembly 30 moves rearward such that left upper carriage wheel 33 and left lower carriage wheels 34 roll rearward along left wheel carriage track 31. This causes left first leg support linkage bar 15 to move rearward as the second end of left first leg support linkage bar 15 pivots with the first end of left second leg support linkage bar 17 about left leg support linkage bar pivot 16. This causes the first end of left second leg support linkage bar 17 to swing rearward as the second end of left second leg support linkage bar 17 pivots about left linkages connection hub pivot 91. Concurrent to this motion, left lever 71 and left handle 72 pivot forward about left lever pivot 74 causing left lever linkage bar 75 to move forward as the first end left lever linkage bar 75 pivots about left lever linkage bar pivot 77. This causes the second end of left lever linkage bar 75 to pivot about left linkages connection hub flange forward pivot 94 as left linkages connection hub pivot 91 rotates forward. This causes left rocker arm linkage bar 53 to move upward as the second end of left rocker arm linkage bar 53 pivots about left linkages connection hub flange rear pivot 93. This causes the first end of left rocker arm linkage bar 53 to pivot about rocker arm left end linkage pivot 54 as rocker arm 51 pivots about rocker arm pivot axle 56 and the left end of rocker arm 51 moves upward.

During operation in a first direction of motion of the right side components of machine 1, when right foot flatform 14 and shin pad 11 move forward, right wheel carriage assembly 30 moves forward such that right upper carriage wheel 33 and right lower carriage wheels 34 roll forward along right wheel carriage track 31. This causes right first leg support linkage bar 15 to move forward as the second end of right first leg support linkage bar 15 pivots with the first end of right second leg support linkage bar 17 about right leg support linkage bar pivot 16. This causes the first end of right second leg support linkage bar 17 to swing forward as the second end of right second leg support linkage bar 17 pivots about right linkages connection hub pivot 91. Concurrent to this motion, right lever 71 and right handle 72 pivot rearward about right lever pivot 74 causing right lever linkage bar 75 to move rearward as the first end right lever linkage bar 75 pivots about right lever linkage bar pivot 77. This causes the second end of right lever linkage bar 75 to pivot about right linkages connection hub flange forward pivot 94 as right linkages connection hub pivot 91 rotates rearward. This causes right rocker arm linkage bar 53 to move downward as the second end of right rocker arm linkage bar 53 pivots about right linkages connection hub flange rear pivot 93. This causes the first end of right rocker arm linkage bar 53 to pivot about rocker arm right end linkage pivot 55 as rocker arm 51 pivots about rocker arm pivot axle 56 and the right end of rocker arm 51 moves downward.

During operation of a second direction motion of the left and right side components of machine 1, the motions of the left and right side components are reversed as previously described herein. During the first or second direction motions of all embodiments of the invention, user U is in total control of the range of the exercise motions of all embodiments of the invention without having to making any adjustments to any of the features or components of any embodiment of the invention. In other words, user U can properly operate any embodiment of the invention by moving wheel carriages assembly 30 and levers 71 any distance in a forward or rearward motion simply by how far they choose to push or pull wheel carriages assembly 30 and levers 71. No components of any embodiments of the invention require the user U to move wheel carriage assemblies 30 and levers 71 any set distance to properly operate machine 1.

Now referring to FIGS. 5-15, the function of machine 1 has been described and illustrated in FIGS. 1-4 as a crawling simulation light exertion exercise or stretching machine. FIGS. 5-14 illustrate machine 1 coupled with various resistance mechanisms for increasing the exertion level of the exercise motion. Each of these resistance mechanisms has their own unique mechanical features and performance characteristics as will be described herein.

FIGS. 5-9 illustrate machine 1 with a sliding magnetic resistance comprising a magnetic resistance mechanism 20 and a resistance adjustment assembly 40.

Figure 6:
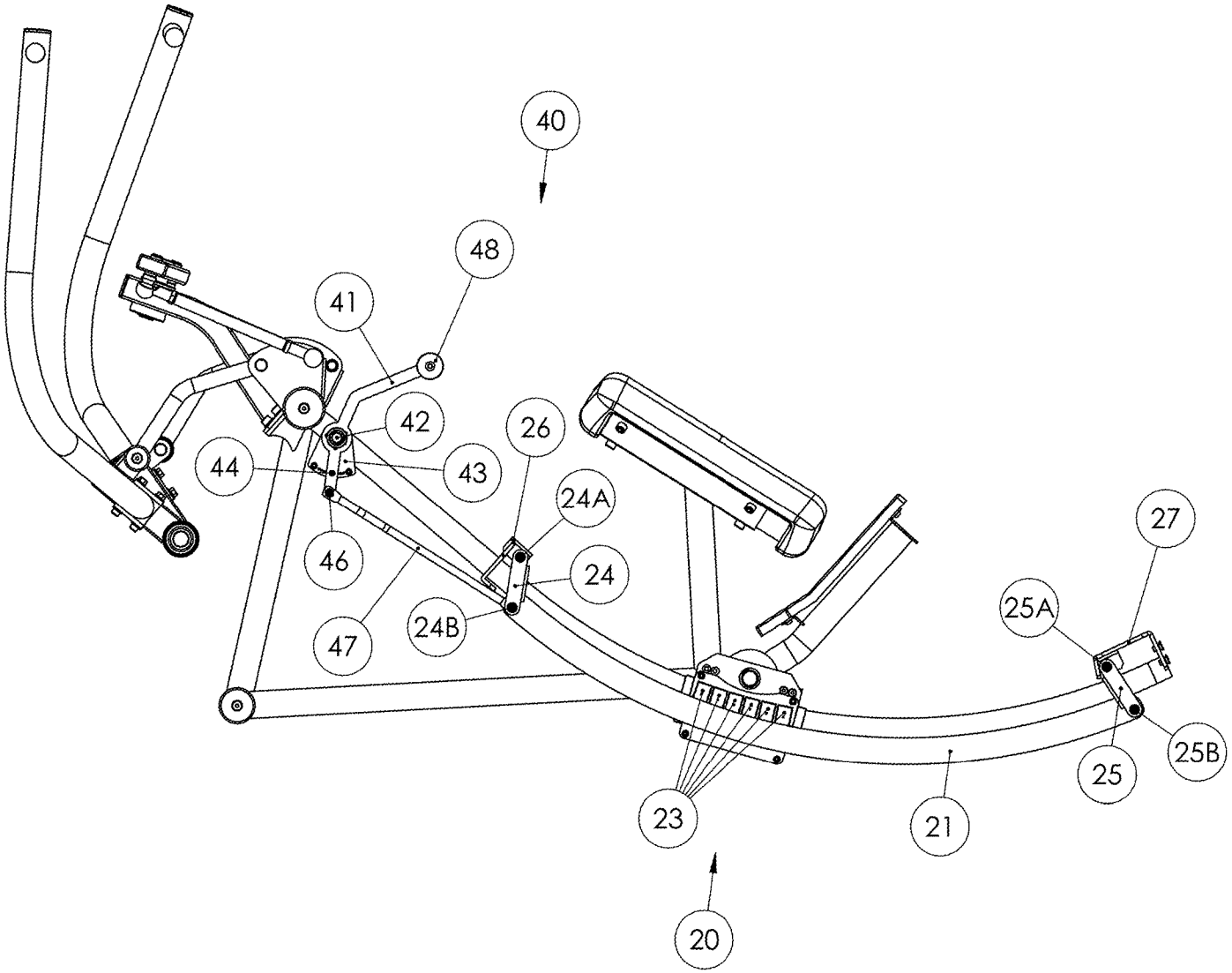
FIG. 6 is a side view of the first embodiment of the invention with magnetic resistance and some components removed.
Figure 7:
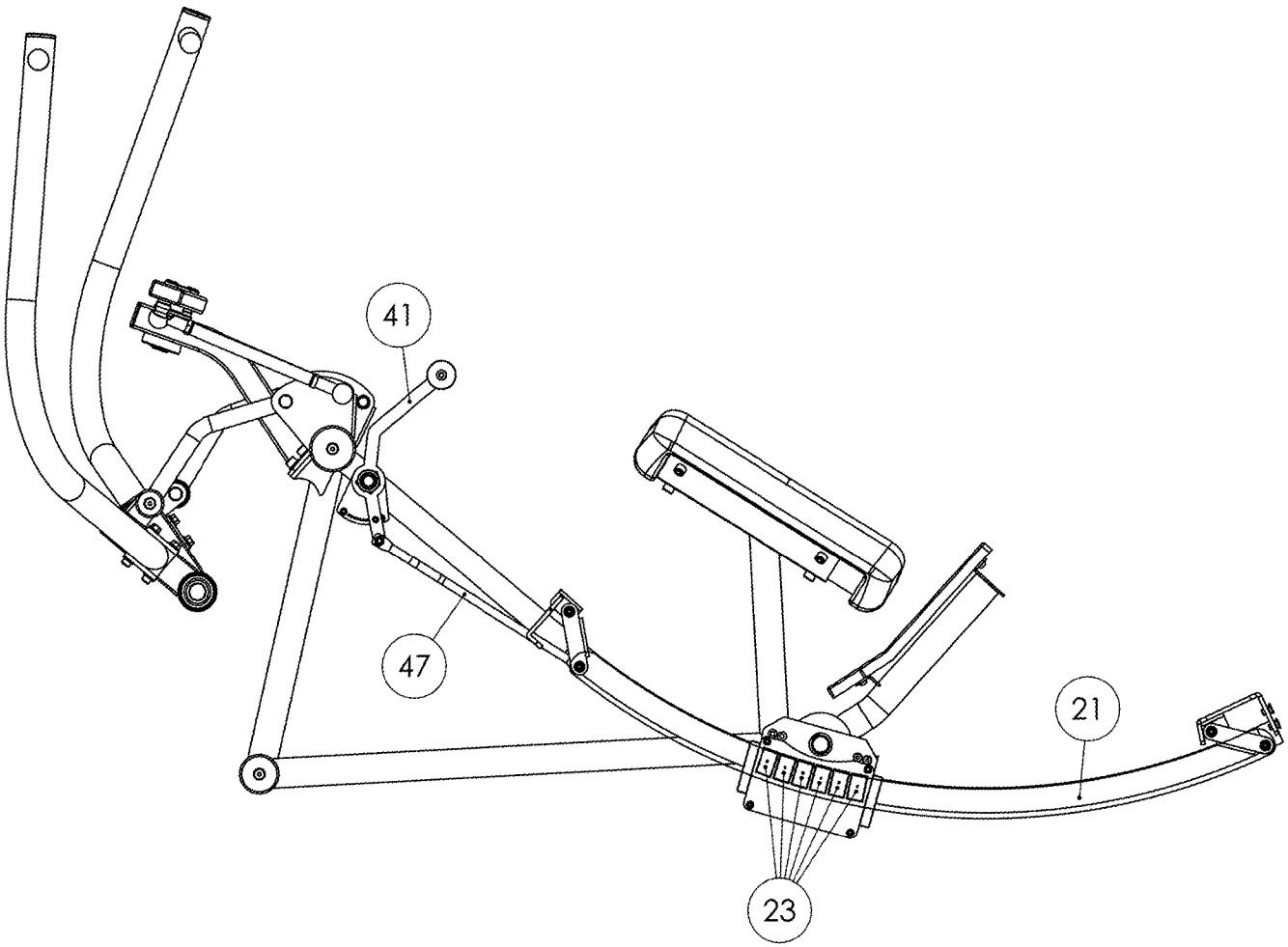
FIG. 7 is a left side view of the first embodiment of the invention with magnetic resistance and some components illustrated as transparent.
Figure 9:
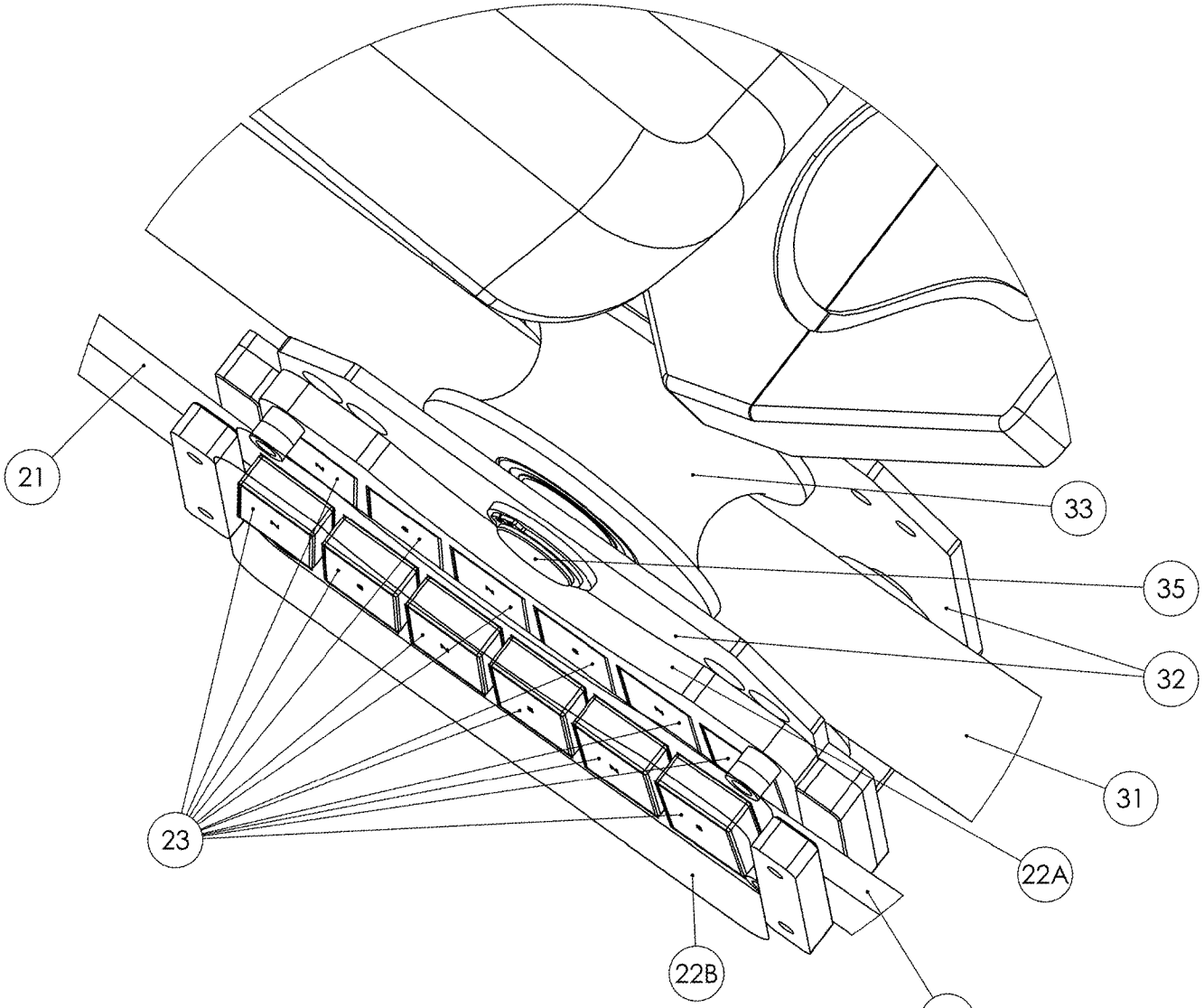
FIG. 9 is an isolated view of components of the first embodiment of the invention with some components illustrated as transparent.

As best illustrated in FIGS. 6, 7, and 9, magnetic resistance mechanism 20 is comprised of a left and right first magnets housings 22A and a left and right second magnet housings 22B. Magnets housings 22A and 22B are rigid mostly rectangular shaped plates that are constructed from a magnetic material such as steel. Left and right first magnets housings 22A are rigidly connected to the inward side of left and right wheel carriage housings 32, respectively, such that first magnets housings 22A cover most of the space of the vertical side of each wheel carriage housing 32 that is facing the opposing wheel carriage housing 32. As illustrated in the isolated view of FIG. 9, left and right first magnets housings 22A are rigidly connected to left and right second magnets housings 22B, respectively, at a spaced location such that first magnets housings 22A and second magnet housings 22B are rigidly connected in a mirror configuration with a spaced gap in between first magnets housings 22A and second magnets housings 22B.

FIG. 9 is illustrated with a transparent view of second magnets housing 22B to show a better view of how magnets 23 are housed in second magnets housing 22B. Each magnets housing 22A and 22B is constructed with recessed pockets to accept a series of magnets 23 that are aligned along first magnets housings 22A and second magnets housings 22B. The recessed pockets in each of first magnets housings 22A and each of second magnets housings 22B are horizontally aligned in an arc shaped pattern that matches the arc shaped pattern of wheel carriage tracks 31. The magnets housed in left first magnets housings 22A are in a mirrored configuration with the magnets housed in left second magnets housings 22B and the magnets housed in right first magnets housings 22A are in a mirrored configuration with the magnets housed in right second magnets housings 22B. Magnets 23 fit in the recessed pockets of left and right magnets housings 22A and left and right magnets housings 22B such that magnets 23 are flush or nearly flush to the surfaces of the left and right first magnets housings 22A and left and right second magnets housings 22B that face each other. These recessed pockets in magnets housings 22A and 22B also keep magnets 23 separated so as to not impede their magnet performance. As represented, there are six magnets 23 housed in first magnets housings 22A and six magnets 23 housed in second magnets housing 22B; however, other amounts of magnets may be implemented to achieve the desired amount of magnetic resistance to the exercise motion.

Magnetic resistance mechanism 20 also comprises left and right conductive blades 21 that are each elongated arc shaped blades that can be constructed of various conductive material, with aluminum and copper being the most common materials. In length, conductive blades 21 span the travel distance of the forward and rearward motions of wheel carriage assemblies 30. The arc shape of conductive blades 21 matches the arc shape of wheel carriage tracks 31. These left and right conductive blades 21 are horizontally spaced from and parallel to left and right wheel carriage tracks 31, respectively, such that left and right conductive blades 21 are always in horizontal alignment with each other and suspended at spaced locations in between left and right wheel carriage tracks 31. Left conductive blade 21 is spaced off of left wheel track 31 such that it is in vertical alignment with the gapped space between left first magnets housings 22A and left second magnets housings 22B. Right conductive blade 21 is spaced off of right wheel track 31 such that it is in vertical alignment with the gapped space between right first magnets housings 22A and right second magnets housings 22B.

Left and right conductive blades 21 are adjustably connected to machine 1 as follows. A conductive blade forward support bar mounting bracket 26 is connected to forward portions of left and right wheel tracks 31 such that conductive blade forward support bar mounting bracket 26 is suspended above and in between left and right wheel tracks 31. A conductive blade rear support bar mounting bracket 27 is rigidly connected to the upper end of rear support frame 5 and extends slightly forward of rear support frame 5 such that conductive blade rear support bar mounting bracket 27 is suspended above and in between left and right wheel tracks 31. A conductive blade forward support bar 24 supports the forward ends of left and right conductive blades 21. Conductive blades forward support bar 24 is a rectangular bar with a left side and a right side and is pivotally connected to conductive blades forward support bar mounting bracket 26 with conductive blade forward support bar upper pivot 24A. The left side of conductive blade forward support bar lower pivot 24B is pivotally connected to the forward end of left conductive blade 21 and the right side of conductive blade forward support bar lower pivot 24B is pivotally connected to the forward end of right conductive blade 21. A conductive blades rear support bar 24 supports the rearward ends of left and right conductive blades 21. Conductive blades rear support bar 25 is a rectangular bar with a left side and a right side and is pivotally connected to conductive blades rear support bar mounting bracket 26 with conductive blade rear support bar upper pivot 25A. The left side of conductive blade rear support bar lower pivot 25B is pivotally connected to the rearward end of left conductive blade 21 and the right side of conductive blade rear support bar lower pivot 24B is pivotally connected to the rearward end of right conductive blade 21.

In this configuration, left and right conductive blades 21 are movably suspended between conductive blade forward support bar 24 and conductive blade rear support bar 24 such that left and right conductive blades 21 pass through the spaced gaps in between left and right first magnets housings 22A and second magnets housings 22B respectively. However, conductive blades 21 do not touch first magnets housings 22A, second magnets housings 22B, or magnets 23, but rather conductive blades 21 occupy a portion of the space in between first magnets housings 22A and second magnets housings 22B with a small space remaining between the outer vertical faces of magnetic blades 21 and the magnets housed in first magnets housings 22A and a small space remaining between the inner vertical faces of magnetic blades 21 and the magnets housed in second magnets housings 22B.

Figure 8:
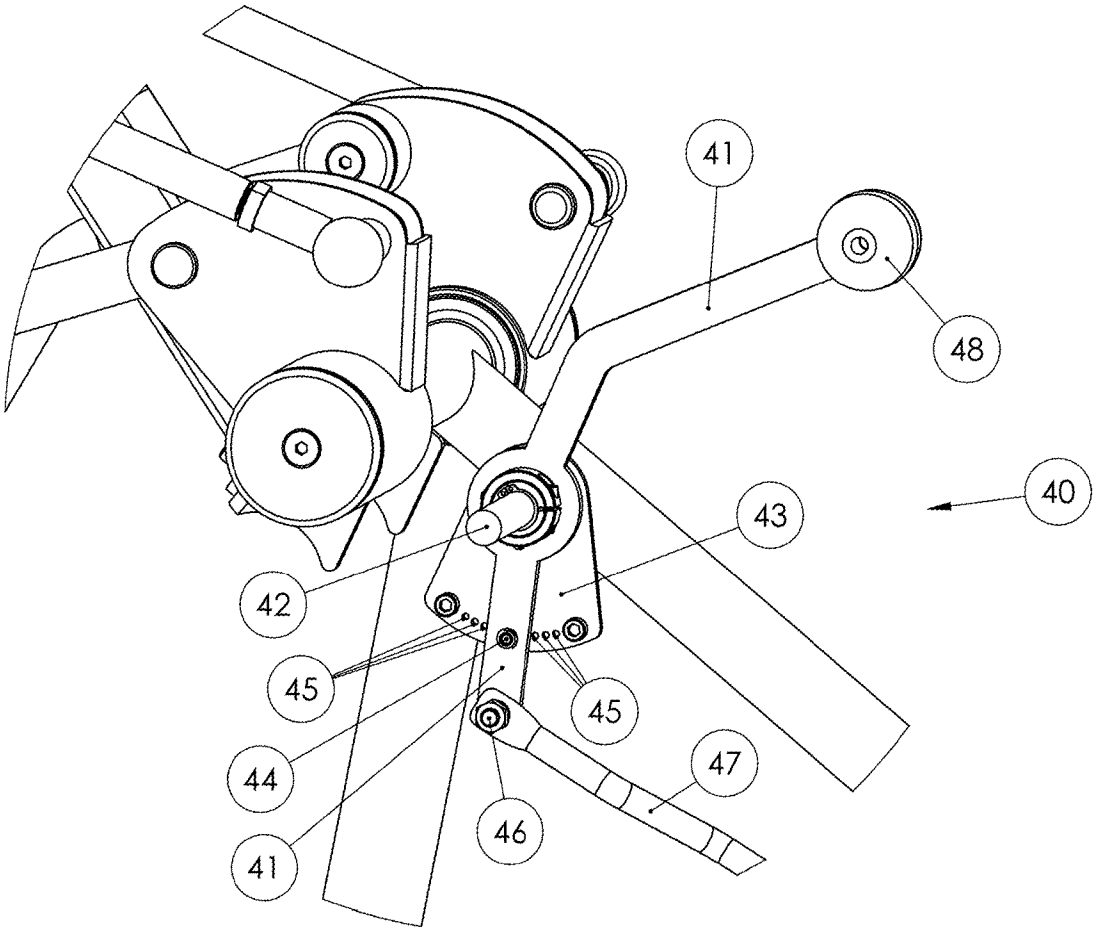
FIG. 8 is an isolated view of components of the first embodiment of the invention.

This configuration of the magnets 23 and the left and right conductive blades 21 creates a magnetic field of resistance in the space between the magnets 23 and the left and right conductive blades 21 as left and right wheel carriages assembly 30 moves along left and right wheel carriages tracks 31 respectively. The amount of magnetic resistance created by magnetic resistance mechanism 20 can be adjusted with a resistance adjustment assembly 40. The components and function of resistance adjustment assembly 40 are best illustrated in FIGS. 6, 7, and 8.

Resistance adjustment assembly 40 is configured as follows. A resistance adjustment lever pivot axle 42 is rigidly mounted proximal to the forward ends of left wheel carriage track 31 and right wheel carriage track 31 in a transverse configuration. A central portion of a resistance adjustment lever 41 is pivotally mounted on resistance adjustment lever pivot axle 42 such that resistance adjustment lever 41 can be pivoted forward and rearward about resistance adjustment lever pivot axle 42 on machine 1. A handle 48 is rigidly connected to the upper end of resistance adjustment lever 41. The lower end of resistance adjustment lever 41 comprises a resistance adjustment lever linkage bar pivot 46. A spring loaded detent pin 44 is mounted on resistance adjustment lever 41 at a perpendicular angle central to resistance adjustment lever linkage bar pivot 46 and resistance adjustment lever pivot axle 42. A mostly triangular shaped locking plate 43 is rigidly connected to resistance adjustment lever pivot axle 42 adjacent to resistance adjustment lever 41 such that detent pin 44 is perpendicular to locking plate 43 and detent pin 44 engages locking plate 43. A series of detent pin receiver holes 45 pass through the lower portion of locking plate 43 and detent pin receiver holes 45 are in alignment with the swinging path of detent pin 44 such that detent pin 44 will engage with a detent pin receiver hole 45 to secure a position of resistance adjustment lever 41 during operation of machine 1. The first end of a resistance adjustment lever linkage bar 47 is pivotally connected to resistance adjustment lever linkage bar pivot 46 and the second end of resistance adjustment lever linkage bar 47 is pivotally connected to conductive blade forward support bar lower pivot 24B.

To operate adjustment resistance assembly 40 in a first direction so as to adjust and increase the amount of magnetic resistance that magnetic resistance mechanism 20 applies to the exercise motion of machine 1, a user U would grip resistance adjustment lever handle 48 while resistance adjustment lever 41 is in a first position and urge resistance adjustment lever handle 48 forward to move resistance adjustment lever 41 away from the first position. This would cause resistance adjustment lever 41 to pivot about resistance adjustment lever pivot axle 42 and cause detent pin 44 to disengage from a detent pin receiver hole 45 as the lower portion of resistance adjustment lever 41 swings rearward. This motion will cause the first end of resistance adjustment lever linkage bar 47 to pivot about resistance adjustment lever linkage bar pivot 46 as resistance adjustment lever linkage bar 47 moves rearward and the second end of resistance adjustment lever linkage bar 47 pivots about conductive blade forward support bar lower pivot 24B as conductive blade forward support bar 24 swings rearward and pivots about conductive blade forward support bar upper pivot 24A. This will cause the forward ends of left and right conductive blades 21 to pivot about conductive blade forward support bar lower pivot 24B as left and right conductive blades 21 swing rearward and upward. This causes the rearward ends of left and right conductive blades 21 to pivot about conductive blade rear support bar lower pivot 25B as conductive blade rear support bar 25 pivots about conductive blade rear support bar upper pivot 25A such that conductive blade rear support bar 25 swings rearward. When the adjustment lever 41 is moved to a second position to increase the amount of magnetic resistance, detent pin 44 will engage with a detent pin receiver hole 45 to secure resistance adjustment lever in the second position. FIG. 7 represents conductive blade 21 as transparent to better illustrate the location of conductive blades 21 relative to magnets 23 when conductive blades 21 are adjusted to the maximum resistance level with resistance adjustment assembly 40. As illustrated in FIG. 6, prior to this first direction motion of resistance adjustment assembly 40, left and right conductive blades 21 are in a lower position relative to the magnets 23 such that there is smaller portion of overlapping surface area of the vertical faces of left and right conductive blades 21 with the vertical faces of magnets 23. When there is smaller portion of overlap of the vertical faces of left and right conductive blades 21 with the vertical faces of magnets 23, a smaller amount of magnetic resistance to the motion of machine 1 is created. When there is a larger portion of overlap of the vertical faces of left and right conductive blades 21 with the vertical faces of magnets 23, a larger amount of magnetic resistance to the motion of machine 1 is created.

To operate adjustment resistance assembly 40 in a second direction so as to adjust and decrease the amount of magnetic resistance that magnetic resistance mechanism 20 applies to the exercise motion of machine 1, a user U would grip resistance adjustment lever handle 48 while resistance adjustment lever 41 is in a first position and urge resistance adjustment lever handle 48 rearward to move resistance adjustment lever 41 away from the first position. This would cause resistance adjustment lever 41 to pivot about resistance adjustment lever pivot axle 42 and cause detent pin 44 to disengage from a detent pin receiver hole 45 as the lower portion of resistance adjustment lever 41 swings forward. This motion will cause the first end of resistance adjustment lever linkage bar 47 to pivot about resistance adjustment lever linkage bar pivot 46 as resistance adjustment lever linkage bar 47 moves forward and the second end of resistance adjustment lever linkage bar 47 pivots about conductive blade forward support bar lower pivot 24B as conductive blade forward support bar 24 swings forward and pivots about conductive blade forward support bar upper pivot 24A. This will cause the forward ends of left and right conductive blades 21 to pivot about conductive blade forward support bar lower pivot 24B as left and right conductive blades 21 swing forward and downward. This causes the rearward ends of left and right conductive blades 21 to pivot about conductive blade rear support bar lower pivot 25B as conductive blade rear support bar 25 pivots about conductive blade rear support bar upper pivot 25A such that conductive blade rear support bar 25 swings forward. When the adjustment lever 41 is moved to a second position to decrease the amount of magnetic resistance, detent pin 44 will engage with a detent pin receiver hole 45 to secure resistance adjustment lever in the second position. As illustrated in FIG. 7, prior to this second direction motion of resistance adjustment assembly 40, left and right conductive blades 21 are in a higher position relative to the magnets 23 such that there is a larger portion of overlapping surface area of the vertical faces of left and right conductive blades 21 with the vertical faces of magnets 23. When there is a larger portion of overlap of the vertical faces of left and right conductive blades 21 with the vertical faces of magnets 23, a larger amount of magnetic resistance to the motion of machine 1 is created. When there is smaller portion of overlap of the vertical faces of left and right conductive blades 21 with the vertical faces of magnets 23, a smaller amount of magnetic resistance to the motion of machine 1 is created. Left and right conductive blades 21 are always parallel and in horizontal alignment with each other and when left and right conductive blades 21 are adjusted from any first position to any second position, left and right conductive blades 21 always move in unison.

Figure 10:
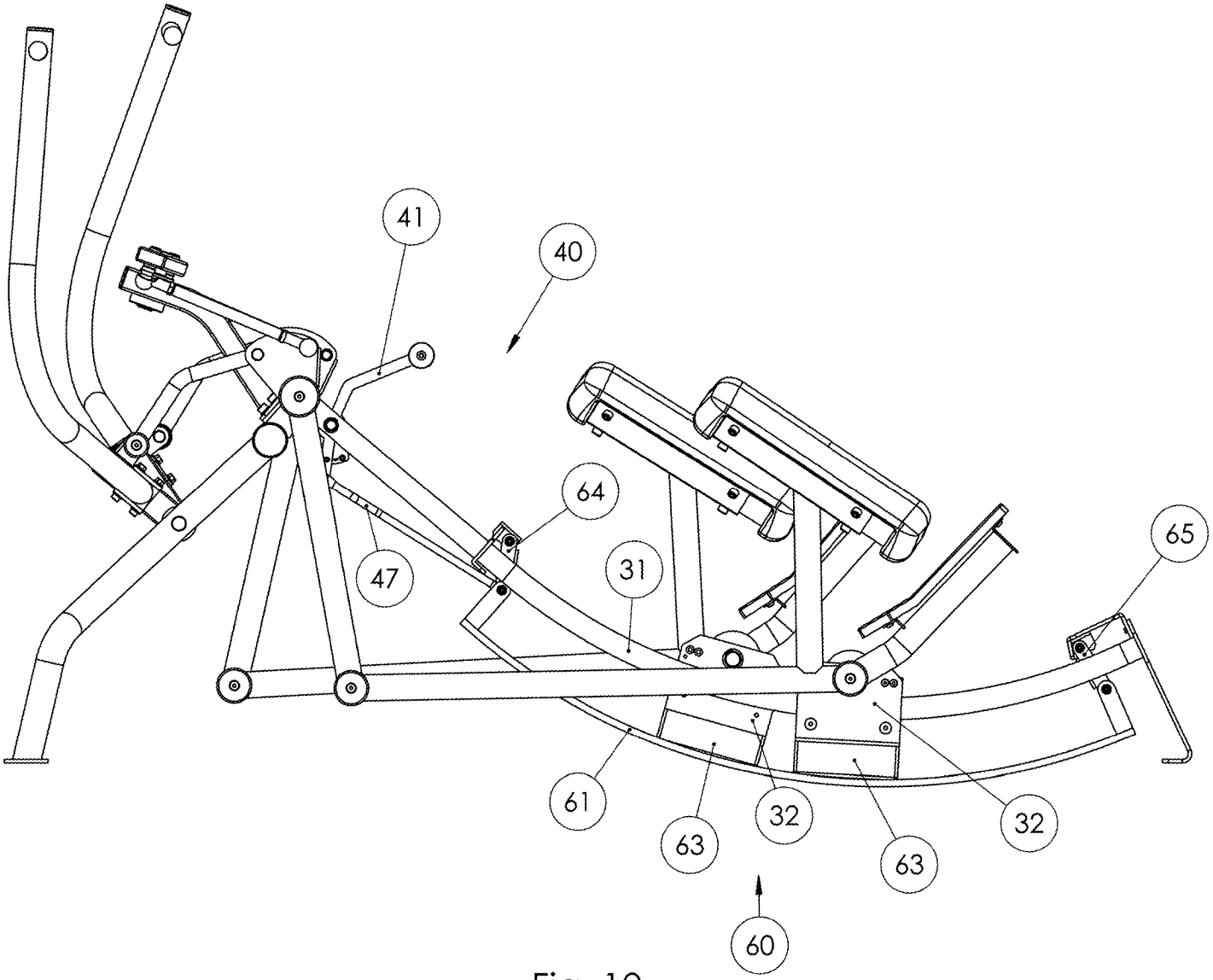
FIG. 10 is a left side view of the first embodiment of the invention with a contact friction resistance mechanism.
Figure 11:
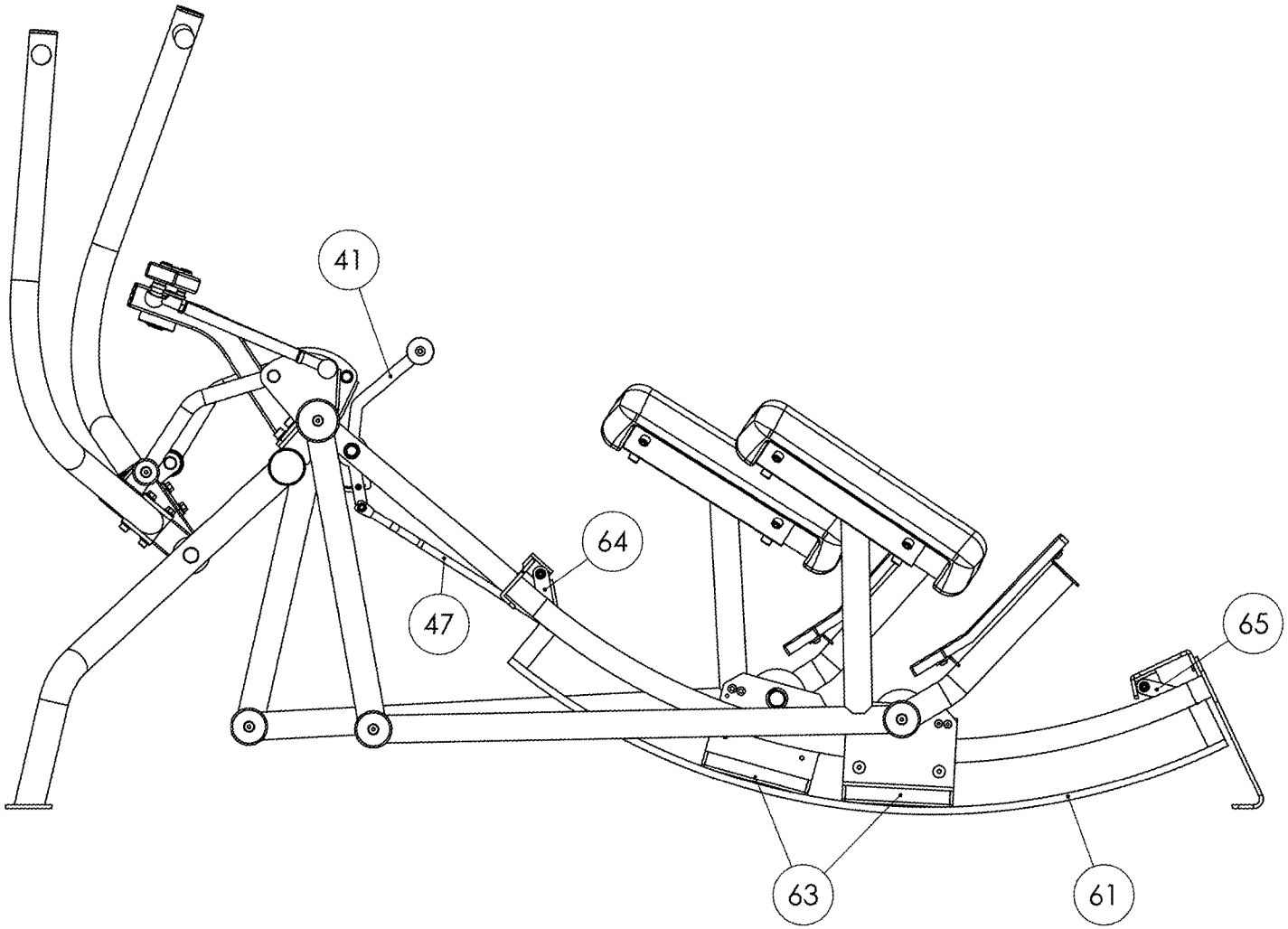
FIG. 11 is a left side view of the first embodiment of the invention with a contact friction resistance mechanism and some components removed.
Figure 12:
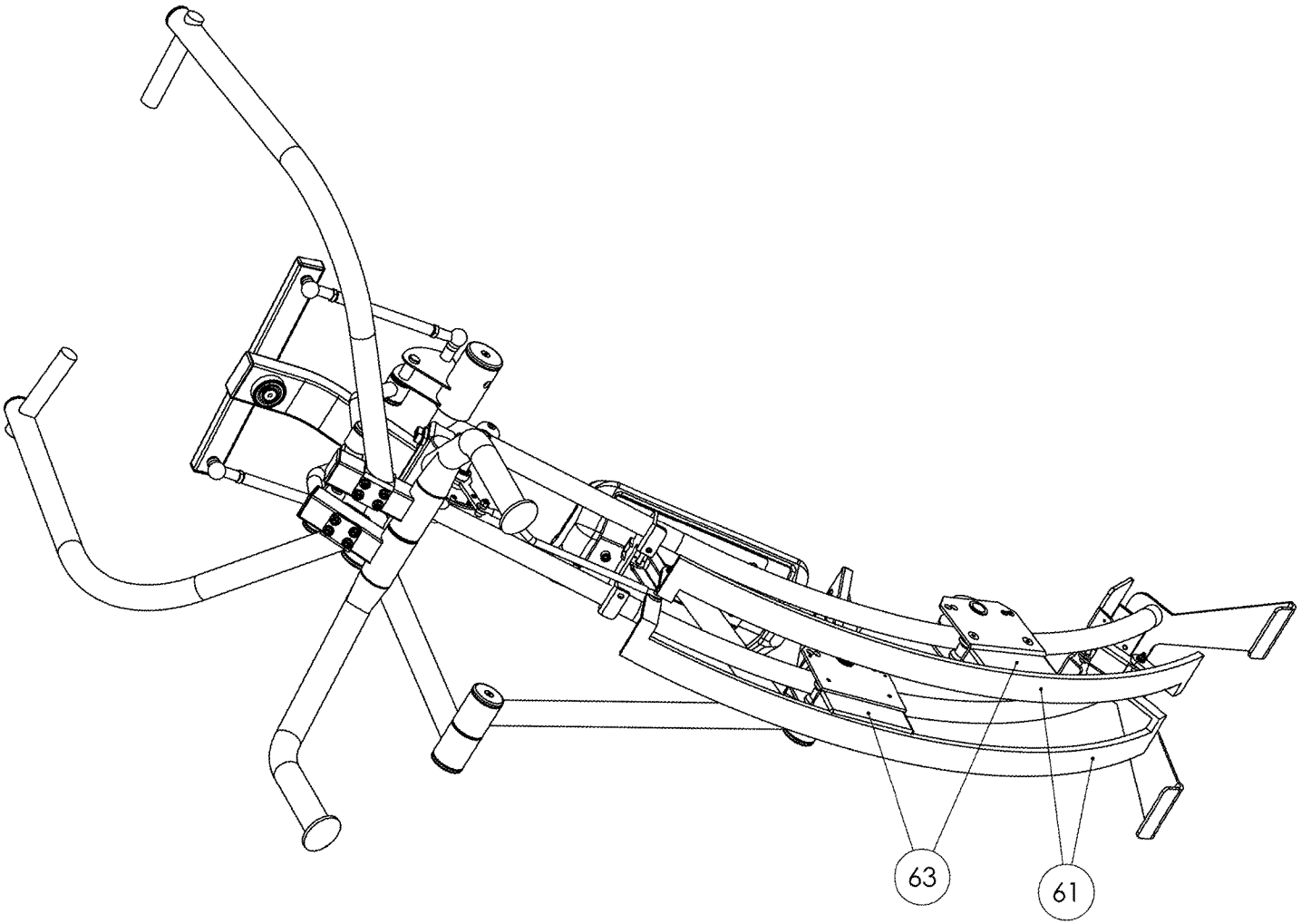
FIG. 12 is a bottom perspective view of the first embodiment of the invention with a contact friction resistance with some components removed.

FIGS. 10, 11, and 12 illustrate machine 1 with a sliding friction resistance feature comprising a friction resistance mechanism 60 and a resistance adjustment assembly 40.

Friction resistance mechanism 60 comprises left and right friction resistance pads 63 each with a top side and a bottom side and the top sides of left and right friction resistance pads 63 are mounted to the bottom sides of left and right wheel carriage housings 32, respectively. Friction pads 63 are represented as rectangular shaped components constructed of durable and flexible material that can be compressed, such as wool or felt by way of example. The bottom sides of left and right friction pads 63 engage left and right friction resistance plates 61, respectively. Left and right friction resistance plates 61 are mostly rectangular arc shaped plates capable of withstanding long term frictional engagement without incurring excessive wear. Hardened steel would be the most common material used for this application. In length, friction resistance plates 61 span the travel distance of the forward and rearward motions of wheel carriage assemblies 30. The width of each friction resistance plate 61 is generally equal to the width of each friction pad 63. The arc shape of friction resistance plates 61 matches the arc shape of wheel carriage tracks 31. A portion of the forward and rearward ends of each friction resistance plate 61 is bent at an approximate right angle to form a forward and rearward connection point for mounting left and right friction resistance plates 61 to machine 1. The forward ends of left and right friction resistance plate 61 are pivotally connected to the left and right sides of the lower end of friction resistance plate forward support bar 64, respectively, and the rearward ends of left and right friction resistance plates 61 are pivotally connected to the left and right sides of the lower end of friction resistance plate rear support bar 64, respectively. When mounted to machine 1, left and right friction resistance plates 61 are in mirrored alignment to each other and parallel to wheel carriage tracks 31. During operation of machine 1, as wheel carriage assemblies 30 move along wheel carriage tracks 31, the bottom sides of left and right friction pads 63 engage and slide along left and right friction resistance plates 61, respectively, creating a friction resistance to the movement of wheel carriage assemblies 30 and machine 1. FIG. 12 illustrates a bottom side view of machine 1 to better illustrate the cooperation between left and right friction pads 63 and friction resistance plate 61.

FIGS. 10 and 11 best illustrate how resistance adjustment assembly 40 cooperates with friction resistance mechanism 60 to adjust the amount of friction resistance to the exercise motion of machine 1. Left and right friction resistance plates 61 are attached to machine 1 with like components and are positioned and move in a like manner as left and right conductive blades 21 such that left and right friction resistance plates 61 and left and right conduct blades 21 are adjusted by resistance adjustment assembly in the identical manner as previously described herein. As illustrated in FIG. 10, when resistance adjustment lever 41 is in a more forward position, left and right friction resistance plates 61 are in a higher position so as to increase the compression of left and right friction resistance pads 63, respectively, against the surface of left and right friction resistance plates 61 creating a larger amount of resistance to the motion of machine 1. As illustrated in FIG. 11, when resistance adjustment lever 41 is in a more rearward position, left and right friction resistance plates 61 are in a lower position so as to decrease the compression of left and right friction resistance pads 63, respectively, against the surface of friction resistance plates 61 creating a smaller amount of resistance to the motion of machine 1. Left and right friction resistance plates 61 are always in mirrored alignment with each other and when left and right friction resistance plates 61 are adjusted from any first position to any second position, left and right friction resistance plates 61 always move in unison.

Figure 13:
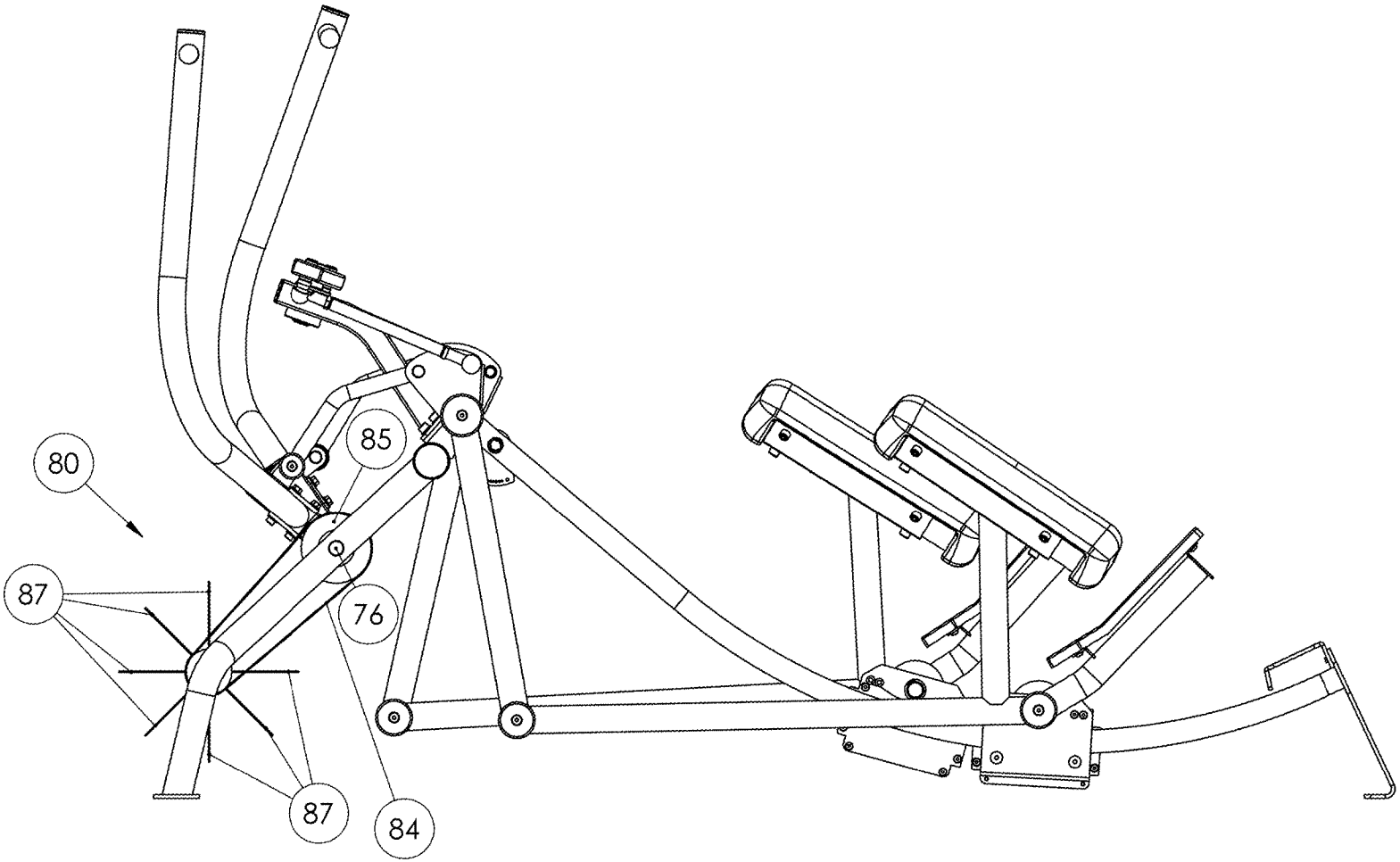
FIG. 13 is a left side view of the first embodiment of the invention with a flywheel and fan blades resistance mechanism.
Figure 14:
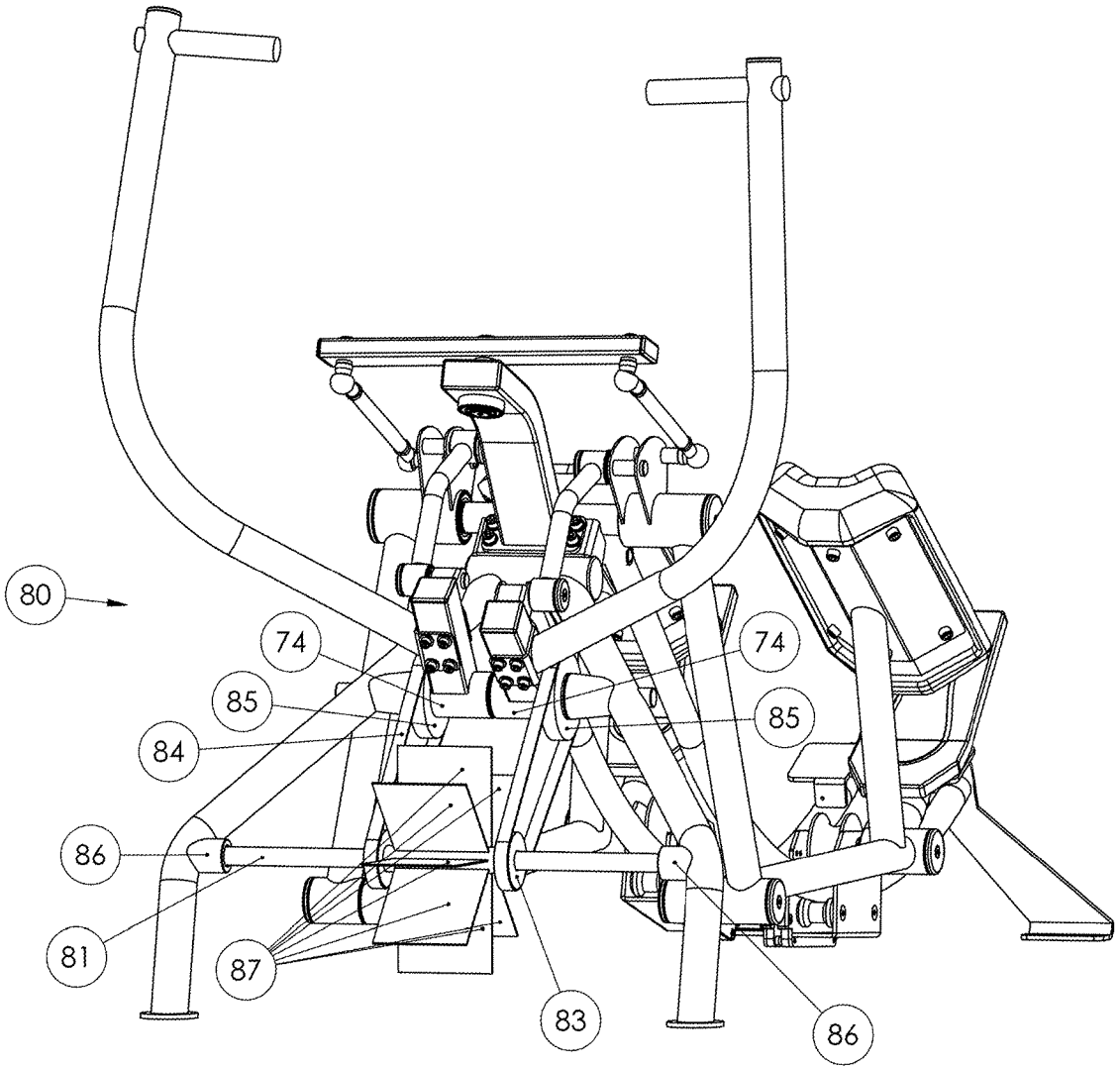
FIG. 14 is a front view of the first embodiment of the invention with a flywheel and fan blade resistance mechanism.
Figure 15:
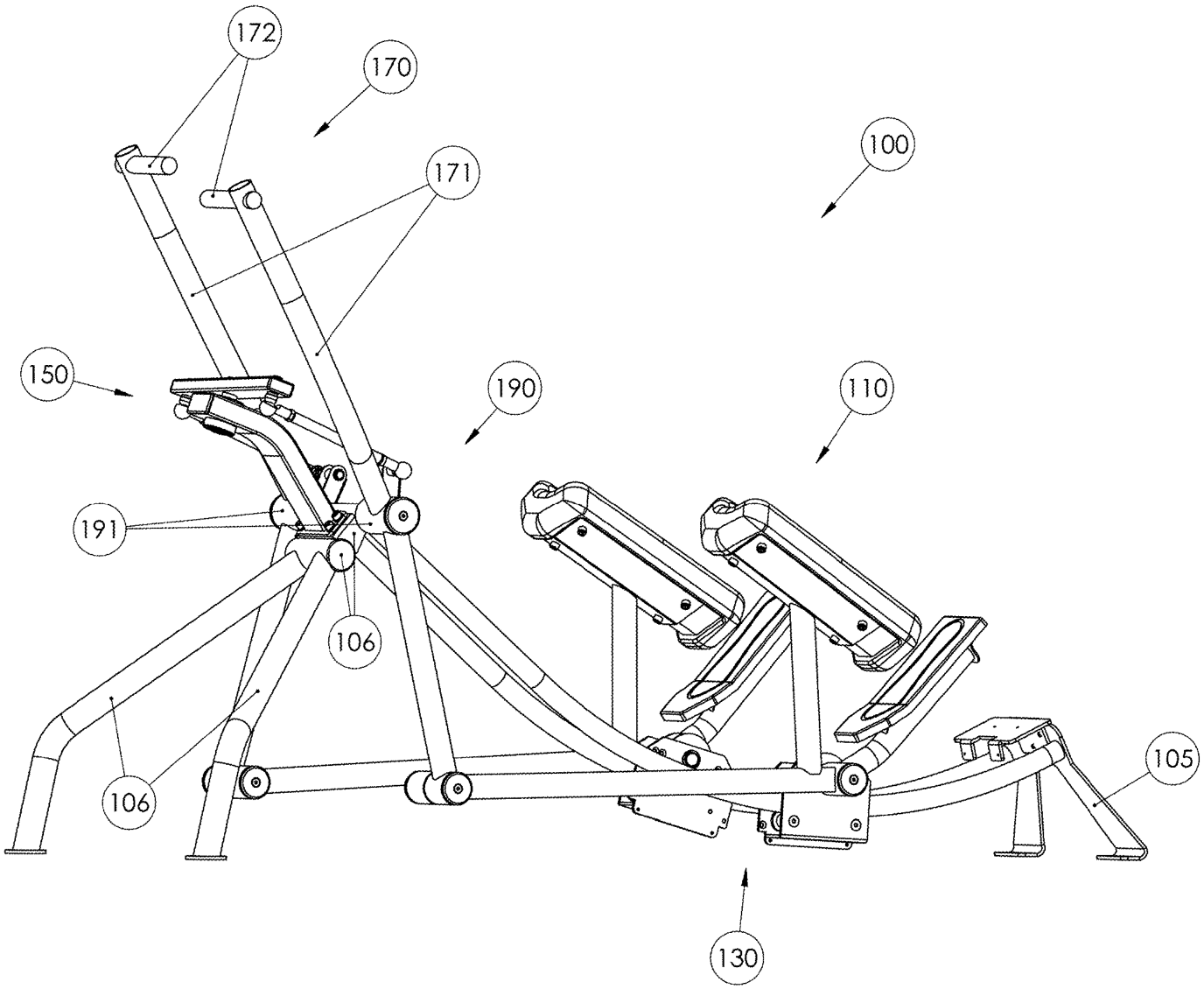
FIG. 15 is a left side perspective view of a second embodiment of the invention.

FIGS. 13 and 14 illustrate a fan blades resistance mechanism 80, wherein a fan blades axle 81 is rotatably mounted on a lower section of front support frame 6 with axle bearings 86. Fan blades 87 are rigidly connected to a central portion of fan blades axle 81 such that fan blades axle 81 and fan blades 87 rotate in unison. Fan blades 87 can be made of any suitable material capable of withstanding the forces of high-speed air displacement, with plastic and metal be the most common material used. Left and right clutch bearing sprockets 83 are rotatably mounted on fan blades axle 81 outward of fan blades 87. Clutch bearing sprockets 83 comprise an inner clutch bearing that freely rotates on fan blades axle 81 in a first direction and engages and propels fan blades axle 81 in the opposite second direction. A sprocket for accepting a flexible drive member such as a belt or chain is mounted on the outside of clutch bearing sprockets 83. Left and right drive belt sprockets 85 are mounted on the outward portions of left and right lever pivots 74, respectively, such that the pivoting motions of left and right levers 71, left and right handles 72, left and right lever mounting tubes 73, and left and right lever pivots 74 as previously described herein moves left and right drive belt sprockets 85, respectively, in first and second directions. Left and right drive belt sprockets 85 are operatively connected to left and right clutch bearing sprockets 83 with left and right drive belts 84, respectively. Other flexible components could be substituted for drive belts 84 such as chains, cables, ropes and the like. Drive belt sprockets 85 are much larger in diameter than clutch bearing sprockets 83 in order to achieve a gear reduction ratio such that fan blades axle 81 and fan blades 87 will rotate at a higher speed than the speed of the pivoting motion of levers 71, handles 72, lever mounting tubes 73, and lever pivots 74. This increased speed of the rotation of fan blades 87 will displace a greater volume of air and create a greater amount of resistance to the exercise motion of machine 1.

During operation of machine 1, the cooperation of the components of fan blades resistance mechanism 80 are as follows. When left lever 71, left handle 72, and left lever mounting tube 73 pivot in a first direction with left lever pivot 74, which causes left drive belt sprocket 85 to move in a first direction causing left drive belt 84 to move in a first direction, which causes left clutch bearing sprocket 83 to move in a first direction to engage and propel the rotation of fan blades axle 81 and fan blades 87. Concurrent to this motion, when right lever 71, right handle 72, and right lever mounting tube 73 pivot in a second direction with right lever pivot 74, which causes right drive belt sprocket 85 to move in a second direction causing right drive belt 84 to move in a second direction, which causes right clutch bearing sprocket 83 to move in a second direction and disengaging from fan blades axle 81 to rotate freely on fan blades axle 81.

When the motions of left and right levers 71, left and right handles 72, left and right lever mounting tubes 73, and left and right lever pivots 74, respectively, are reversed, left lever 71, left handle 72, and left lever mounting tube 73 pivot in a second direction with left pivot lever 74, which causes left drive belt sprocket 85 to move in a second direction causing left drive belt 84 to move in a second direction, which causes left clutch bearing sprocket 83 to move in a second direction and disengage from fan blades axle 81 to rotate freely on fan blades axle 81. Concurrent to this motion, when right lever 71, right handle 72, and right lever mounting tube 73 pivot in a first direction with right lever pivot 74, which causes right drive belt sprocket 85 to move in a first direction causing right drive belt 84 to move in a first direction, which causes right clutch bearing sprocket 83 to move in a first direction to engage and propel the rotation of fan blades axle 81 and fan blades 87.

A higher velocity of the exercise motion of machine 1 increases the resistance created by fan blades resistance mechanism 80. A lower velocity of the exercise motion of machine 1 decreases the resistance created by fan blades resistance mechanism 80.

Now referring to FIGS. 15-19, FIGS. 15-19 represent a second embodiment of the invention, machine 100. Most of the mechanical components of machine 100 are identical in structure, configuration, and function to those of machine 1 as previously described herein with the exception that arm supports assembly 70 of machine 1 has been removed and replaced with an arm supports 170 of machine 100. Linkage connection hub 190 has also been slightly modified to remove the linkages connection hub flange forward pivot of linkages connection hub assembly 90. The other components of machine 1 and machine 100 are identical in structure, configuration, and function as previously described herein. For example, rear support frame 5 of machine 1 is identical to rear support frame 105 of machine 100. Forward support frame 6 of machine 1 is identical to forward support frame 106 of machine 100. Leg supports assembly 10 of machine 1 is identical to leg supports assembly 110 of machine 100. Wheel carriages assembly 30 of machine 1 is identical to wheel carriages assembly 130 of machine 100. Rocker arm assembly 50 of machine 1 is identical to rocker arm assembly 150 of machine 100.

As illustrated in FIG. 15, arms supports assembly 170 comprise left and right levers 171 and left and right handles 172, wherein the first ends of left and right levers 171 are rigidly connected to the upper portion of left and right linkage connected hub pivots 191 and the second ends of left and right levers 171 are rigidly connected to left and right handles 172, respectively. The arcing path of the reciprocating motions of levers 171 and handles 172 of machine 100 are slightly different than the arcing path of motion of levers 71 and handles 72 of machine 1. However, with this minor exception, the overall stretching and exercise motion of machine 100 and machine 1 are nearly identical. The other difference in machine 100 and machine 1 is that the arms support assembly 170 of machine 100 has fewer parts than the arms support assembly 70 of machine 1, thereby reducing the cost and complexity of machine 100 relative to machine 1.

Figure 16:
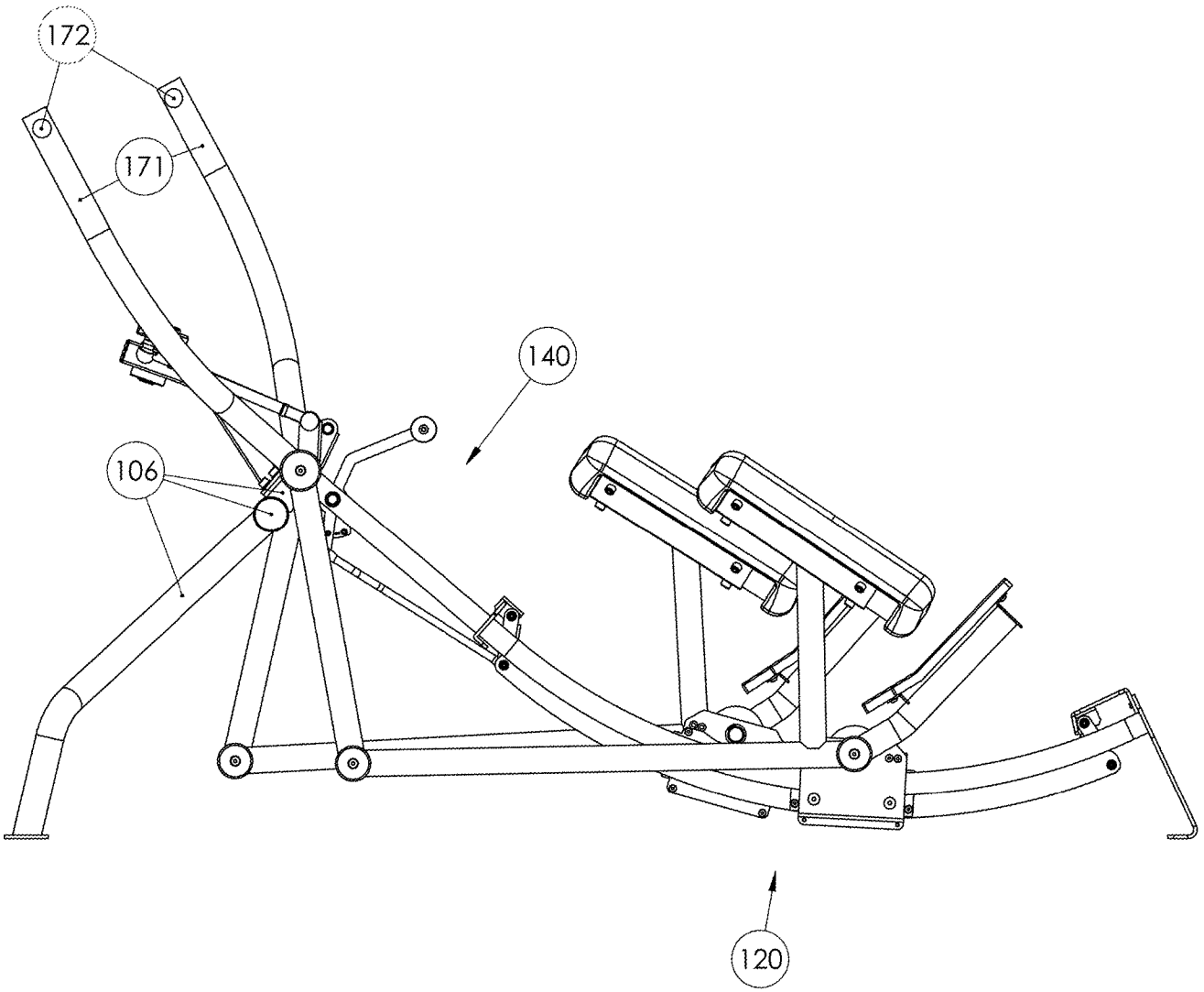
FIG. 16 is a left side view of the second embodiment of the invention with a magnetic resistance mechanism.

FIG. 16 illustrates machine 100 coupled with a magnetic resistance mechanism 120 and a resistance adjustment assembly 140. The components of magnetic resistance mechanism 120 are identical to those of magnetic resistance mechanism 20 of machine 1 in structure, configuration, and function as previously described herein. The components of resistance adjustment mechanism 140 are identical to those of resistance adjustment assembly 40 of machine 1 in structure, configuration, and function as previously described herein.

Figure 17:
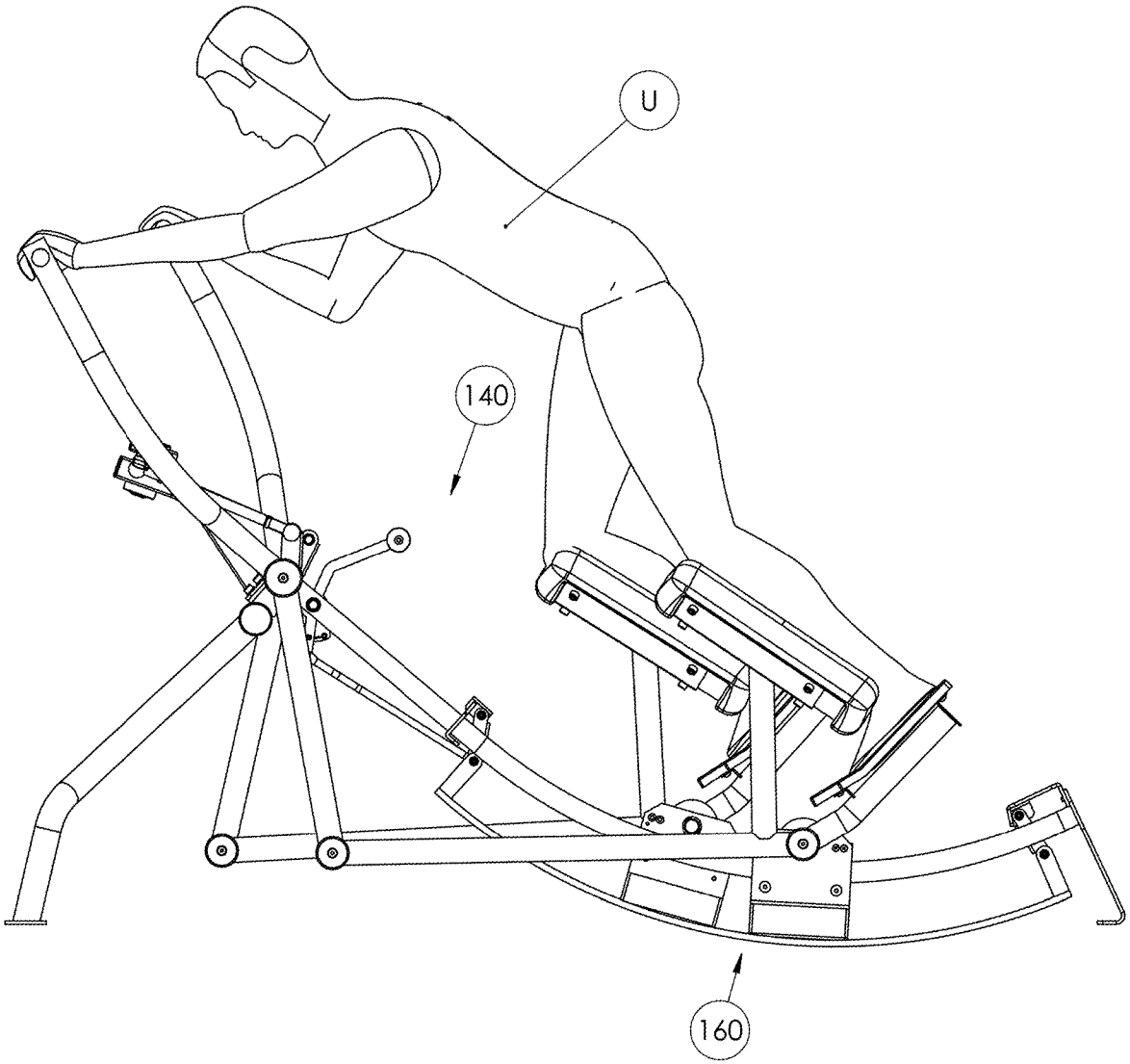
FIG. 17 is a left side view of the second embodiment of the invention with a contact friction resistance mechanism and a user mounted on the machine.

FIG. 17 illustrates machine 100 coupled with a friction resistance mechanism 160 and a resistance adjustment assembly 140. The components of friction resistance mechanism 160 are identical to those of friction resistance mechanism 60 of machine 1 in structure, configuration, and function as previously described herein. The components of resistance adjustment mechanism 140 are identical to those of resistance adjustment assembly 40 of machine 1 in structure, configuration, and function as previously described herein.

Figure 18:
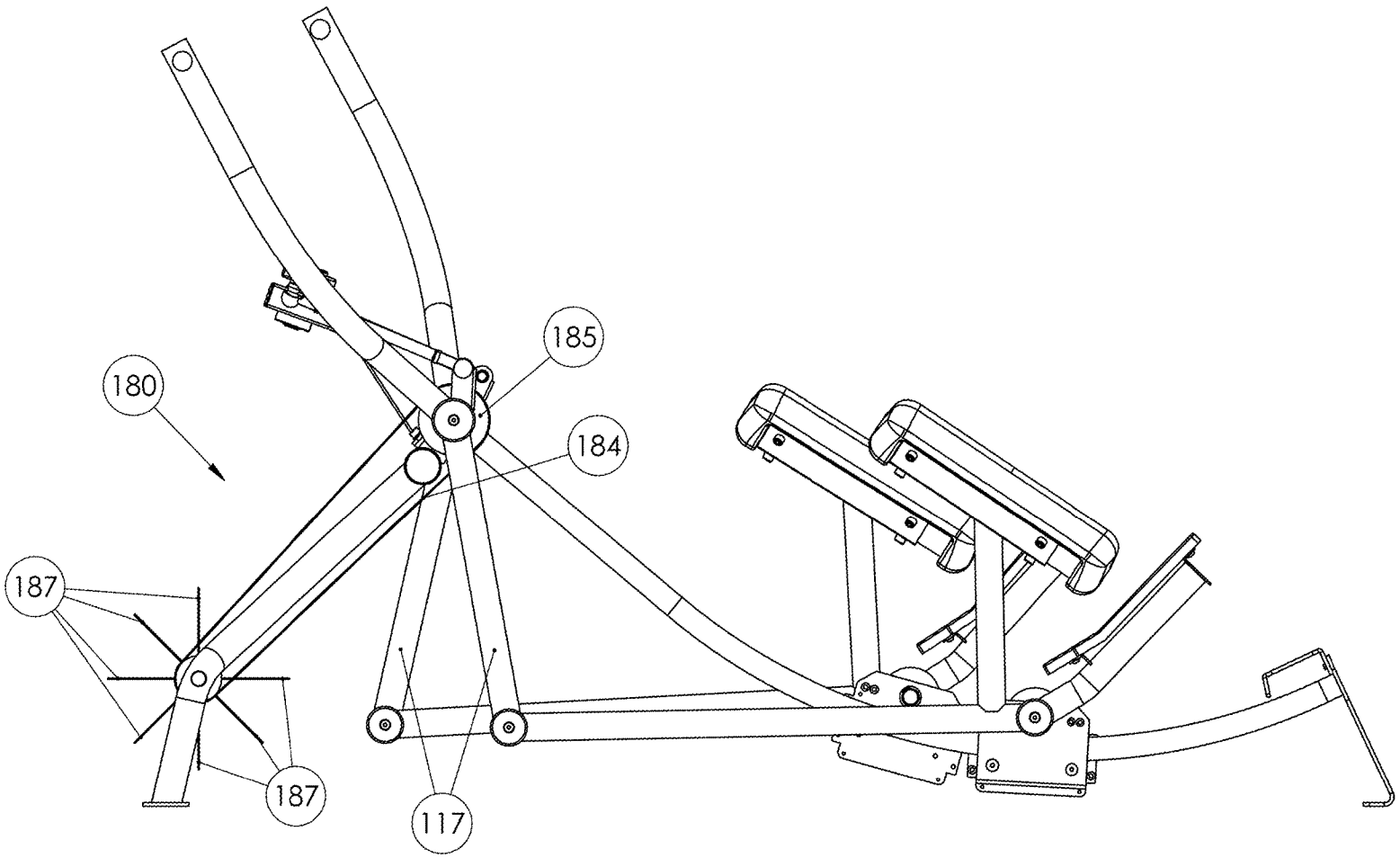
FIG. 18 is a left side view of the second embodiment of the invention with a flywheel and fan blade resistance mechanism.
Figure 19:
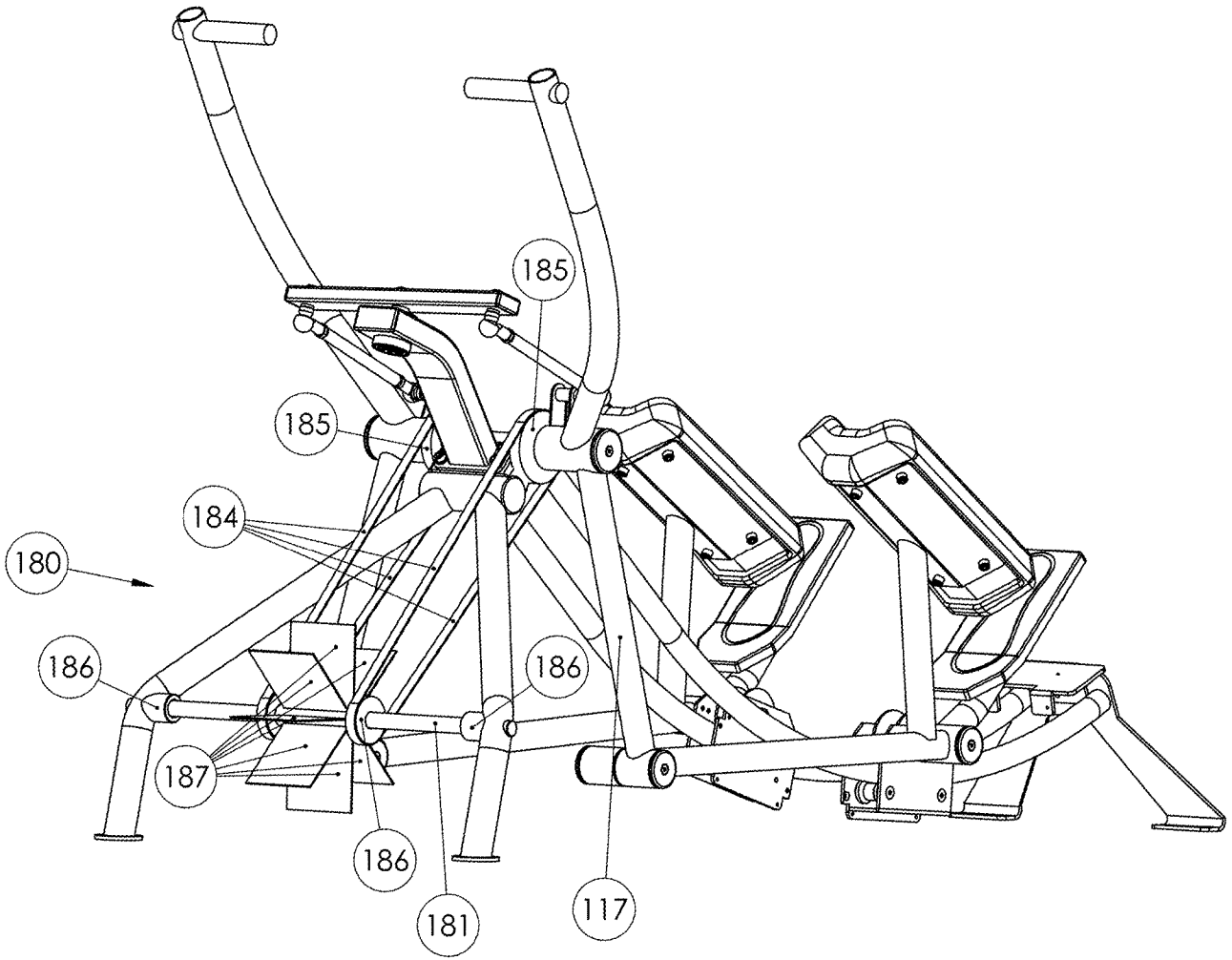
FIG. 19 is a left side perspective view of the second embodiment of the invention with a flywheel and fan blades resistance mechanism.
Figure 20:
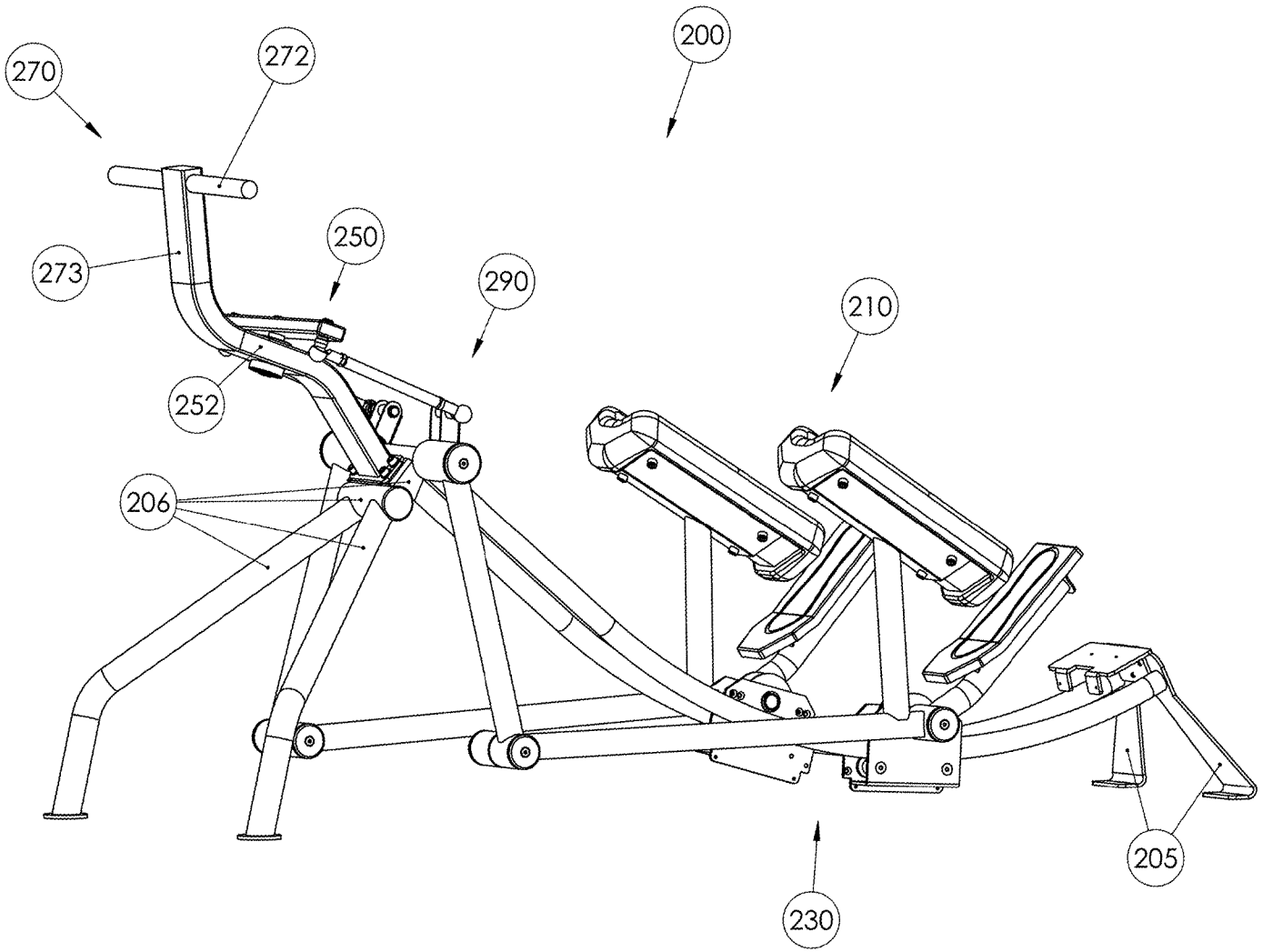
FIG. 20 is a left side perspective view of a third embodiment of the invention.

FIGS. 18 and 19 illustrate machine 100 coupled with a fan blades resistance mechanism 180. Fan blades resistance mechanism 180 functions nearly identical to fan blades resistance mechanism 80 of machine 1. The differences are described in detail as follows. Fan blades resistance mechanism 180 comprises a fan blades axle 81 rotatably mounted on a lower section of front support frame 106 with axle bearings 186. Fan blades 187 are rigidly connected to a central portion of fan blades axle 181 such that fan blades axle 181 and fan blades 187 rotate in unison. Fan blades 187 can be made of any suitable material capable of withstanding the forces of high speed air displacement, with plastic and metal being the most common material used.

Left and right clutch bearing sprockets 183 are rotatably mounted on fan blades axle 181 outward of fan blades 187. Clutch bearing sprockets 183 comprise an inner clutch bearing that freely rotates on fan blades axle 181 in a first direction and engages and propels fan blades axle 181 in the opposite second direction. A sprocket for accepting a flexible drive member such as a belt or chain is mounted on the outside of clutch bearing sprocket 183. Left and right drive belt sprockets 185 are mounted on the inward portions of left and right linkage connection hub pivots 191, respectively, such that the pivoting motions of left and right levers 171, left and right handles 172, and left and right linkage connection hub pivots 191 as previously described herein moves left and right drive belt sprockets 185 respectively in first and second directions. The second ends of left and right second leg supports linkage bars 117 are rigidly connected to the lower portion of left and right linkage connection hub pivots 191, respectively, to also urge the pivoting motions of left and right linkage connection hub pivots 191.

Left and right second leg supports linkage bars 117 are operative components of leg supports assembly 110 as previously described herein. Left and right drive belt sprockets 185 are operatively connected to clutch bearing sprockets 183 with left and right drive belts 184, respectively. Other flexible components could be substituted for drive belts 184 such as chains, cables, ropes, and the like. Drive belt sprockets 185 are much larger in diameter than clutch bearing sprockets 183 in order to achieve a gear reduction ratio such that fan blades axle 181 and fan blades 187 will rotate at a higher speed than the speed of the pivoting motion of levers 171, handles 172, and linkage connection hub pivots 191. This increased speed of the rotation of fan blades 187 will displace a greater volume of air and create a greater amount of resistance to the exercise motion of machine 100.

During operation of machine 100, the cooperation of the components of fan blades resistance mechanism 180 are as follows. When left lever 171, left handle 172, and left second leg support linkage bar 117 pivot in a first direction with left linkage connection hub pivot 191, this causes left drive belt sprocket 185 to move in a first direction causing left drive belt 184 to move in a first direction, which causes left clutch bearing sprocket 183 to move in a first direction to engage and propel the rotation of fan blades axle 181 and fan blades 187. Concurrent to this motion, when right lever 171, right handle 172, and second leg support linkage bar 117 pivot in a second direction with right linkage connection hub pivot 191, this causes right drive belt sprocket 185 to move in a second direction causing right drive belt 184 to move in a second direction, which causes right clutch bearing sprocket 183 to move in a second direction and disengaging from fan blades axle 181 to rotate freely on fan blades axle 181.

When the motions of left and right levers 171, left and right handles 172, left and right second leg support linkage bar 117, and left and right linkage connection hub pivots 191, respectively, are reversed, left lever 71, left handle 72, and left second leg support linkage bar 117 pivot in a second direction with left linkage connection hub pivot 191, which causes left drive belt sprocket 185 to move in a second direction causing left drive belt 184 to move in a second direction, which causes left clutch bearing sprocket 183 to move in a second direction and disengage from fan blades axle 181 to rotate freely on fan blades axle 181. Concurrent to this motion, when right lever 171, right handle 172, and second leg support linkage bar 117 pivot in a first direction with right linkage connection hub pivot 191, this causes right drive belt sprocket 185 to move in a first direction causing right drive belt 184 to move in a first direction, which causes right clutch bearing sprocket 183 to move in a first direction to engage and propel the rotation of fan blades axle 181 and fan blades 187.

A higher velocity of the exercise motion of machine 100 increases the resistance created by fan blades resistance mechanism 180. A lower velocity of the exercise motion of machine 100 decreases the resistance created by fan blades resistance mechanism 180. Now referring to FIGS. 20-24

Now referring to FIGS. 20-24, FIGS. 20-24 represent a third embodiment of the invention, machine 200. Most of the mechanical components of machine 200 are identical in structure, configuration, and function to those of machine 1 and machine 100 as previously described herein with the exception that arm supports assembly 70 of machine 1 and arm supports assembly 170 of machine 100 has been removed and replaced with an arm supports assembly 270 of machine 200. The identical components are as follows. Rear support frame 5 of machine 1 and rear support frame 105 of machine 100 are identical to rear support frame 205 of machine 200. Forward support frame 6 of machine 1 and forward support frame 106 of machine 100 are identical to forward support frame 206 of machine 200. Leg supports assembly 10 of machine 1 and leg supports assembly 110 of machine 100 are identical to leg supports assembly 210 of machine 200. Wheel carriages assembly 30 of machine 1 and wheel carriages assembly 130 of machine 100 are identical to wheel carriages assembly 230 of machine 200. Rocker arm assembly 50 of machine 1 and rocker arm assembly 150 of machine 100 are identical to rocker arm assembly 250 of machine 200. Linkage connection hub assembly 190 of machine 100 is identical to linkage connection hub assembly 290 of machine 200.

As illustrated in FIG. 20 arms supports assembly 170 of machine 100 has been removed and replaced with an arm supports assembly 270. Arm supports assembly 270 is comprised of a stationary handles support tube 273 and left and right stationary handles 272. Stationary handles support tube 273 is connected to the forward end rocker arm support tube 252. Left and right stationary handles 272 are rigidly connected to the upper end of stationary handles support tube 273. This machine 200 embodiment of the invention is a legs only crawling simulation exercise and stretching machine wherein a user U would grip and brace against left and right stationary handles 272 while engaging leg supports assembly 210 to perform a legs only crawling simulation exercise and stretching motion.

Figure 21:
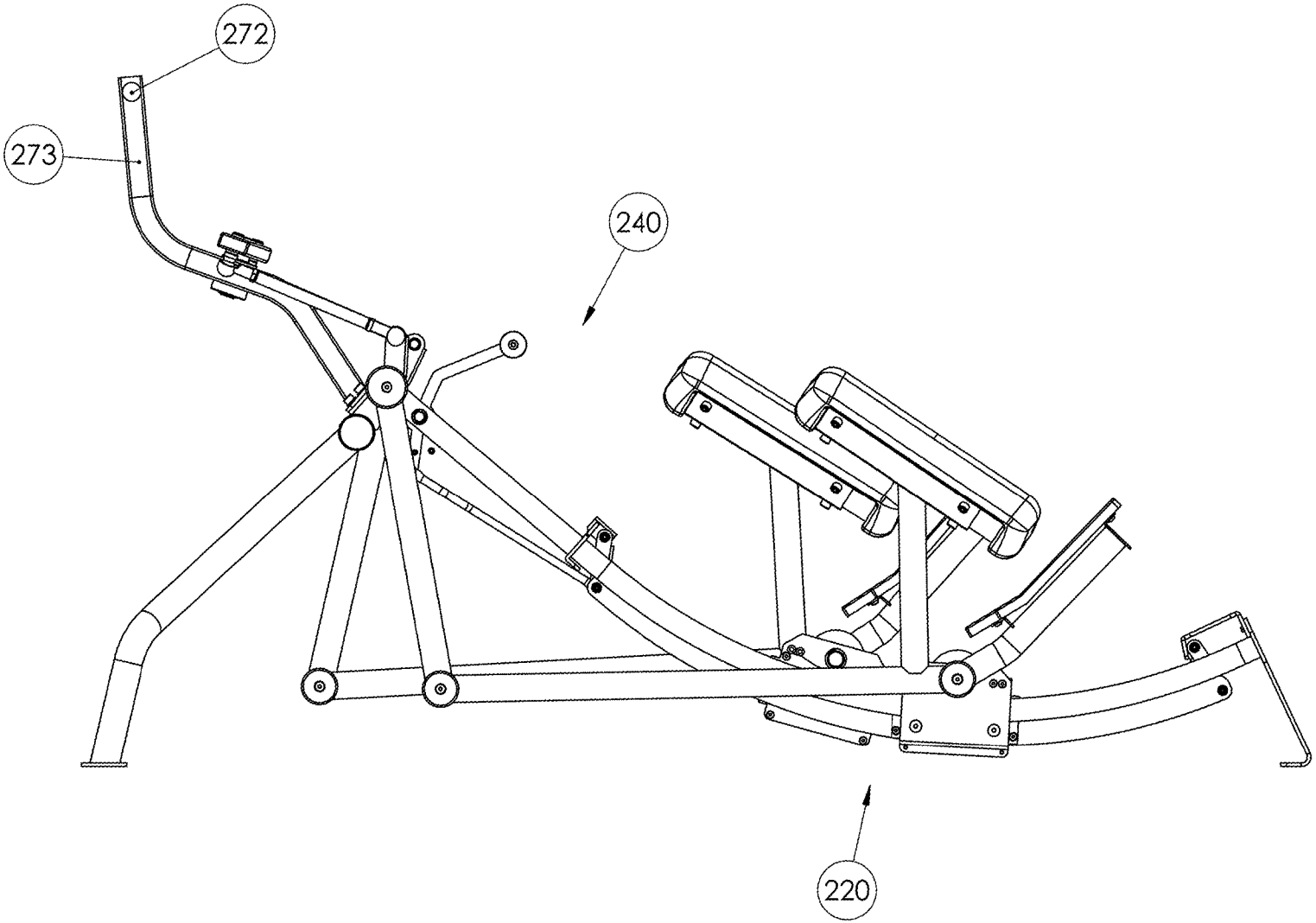
FIG. 21 is a side view of the third embodiment of the invention with a magnetic resistance mechanism.

FIG. 21 illustrates machine 200 coupled with a magnetic resistance mechanism 220 and a resistance adjustment assembly 240. The components of magnetic resistance mechanism 220 are identical to those of magnetic resistance mechanism 20 of machine 1 and magnetic resistance mechanism 120 of machine 100 in structure, configuration, and function as previously described herein. The components of resistance adjustment mechanism 240 are identical to those of resistance adjustment assembly 40 of machine 1 and resistance adjustment assembly 140 of machine 100 in structure, configuration, and function as previously described herein.

Figure 22:
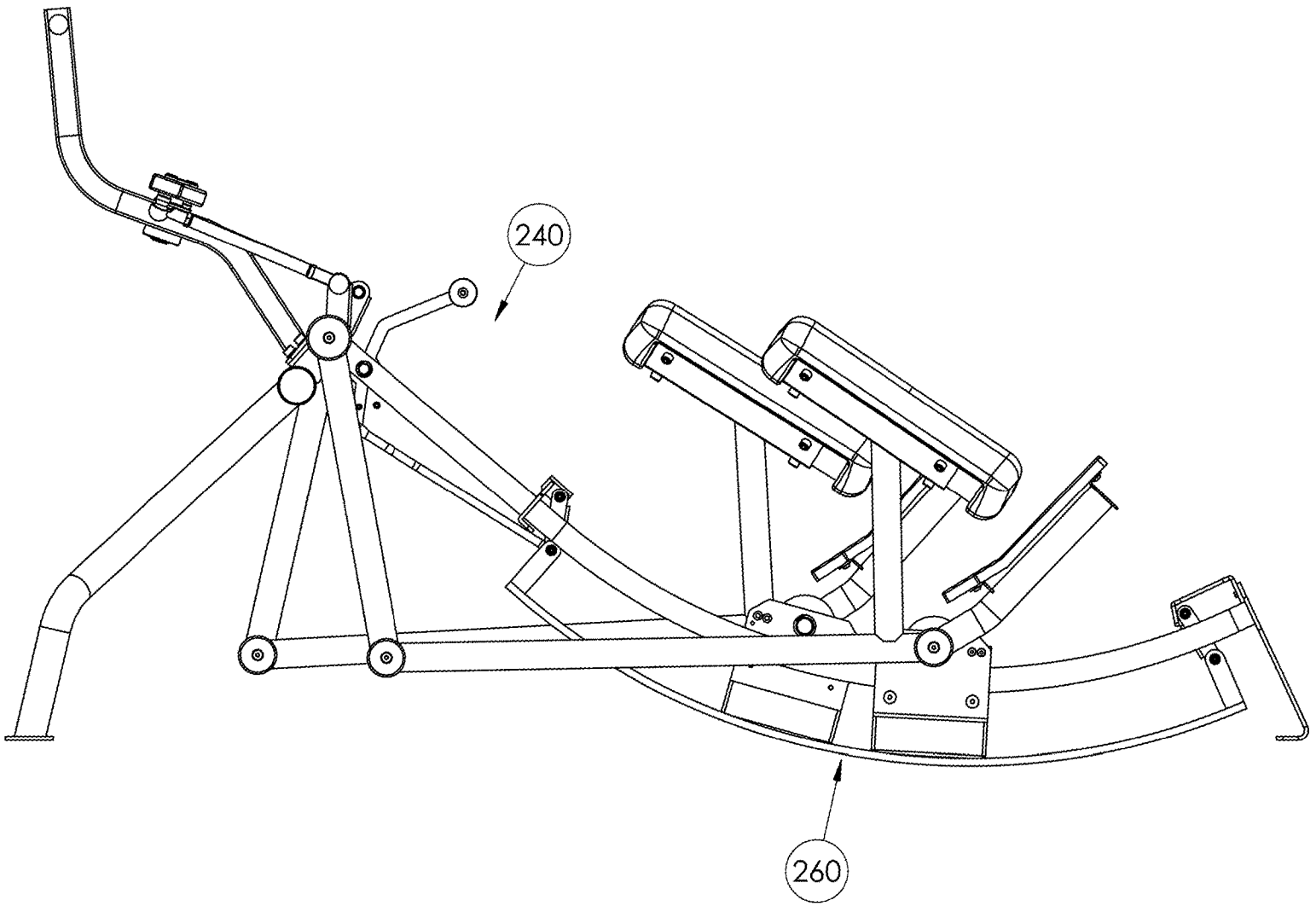
FIG. 22 is a left side view of the third embodiment of the invention with a contact friction resistance mechanism.

FIG. 22 illustrates machine 200 coupled with a friction resistance mechanism 260 and a resistance adjustment assembly 240. The components of friction resistance mechanism 260 are identical to those of friction resistance mechanism 60 of machine 1 and friction resistance mechanism 160 of machine 100 in structure, configuration, and function as previously described herein. The components of resistance adjustment mechanism 240 are identical to those of resistance adjustment assembly 40 of machine 1 and resistance adjustment assembly 140 of machine 100 in structure, configuration, and function as previously described herein.

Figure 23:
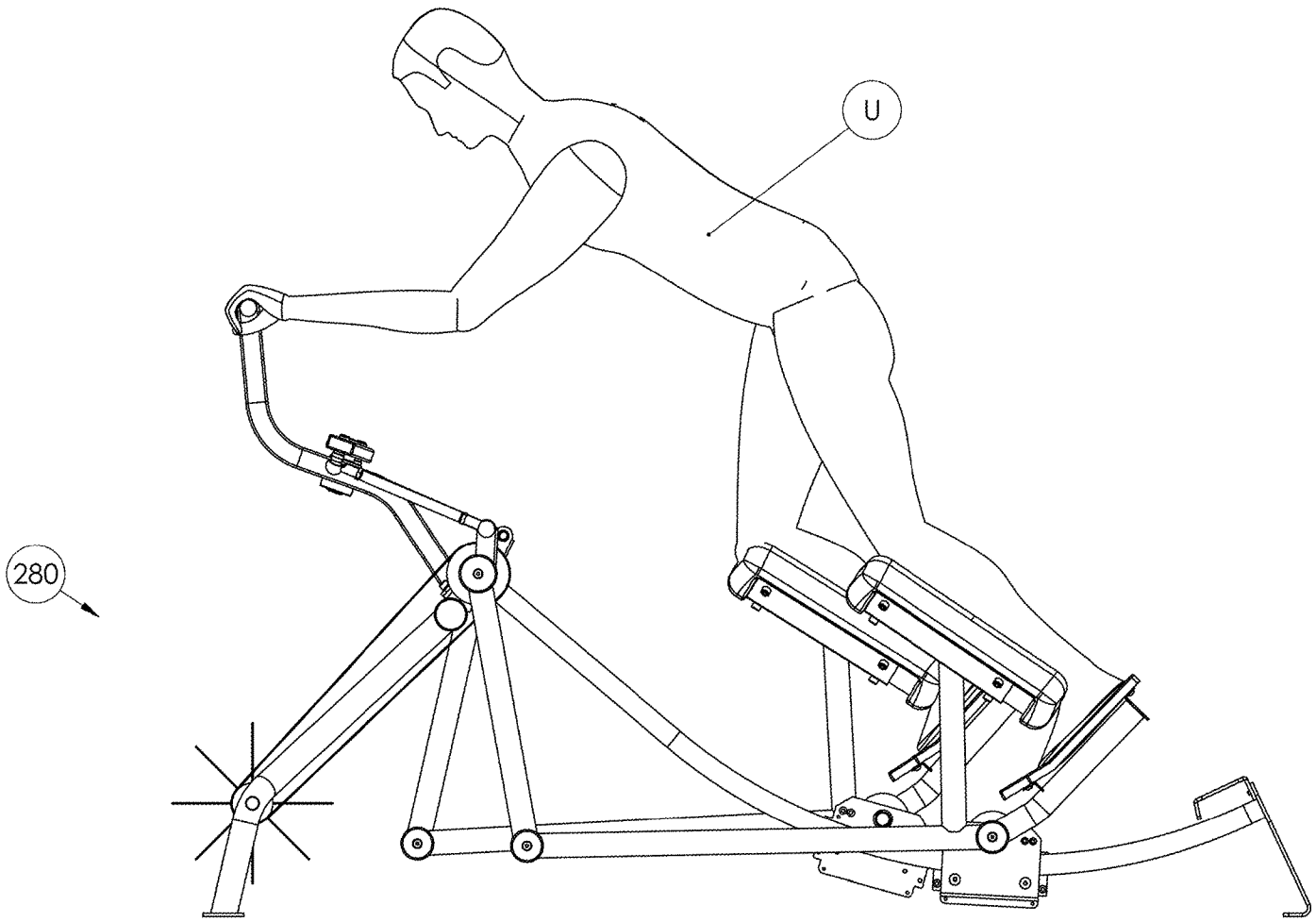
FIG. 23 is left side view of the third embodiment of the invention with a flywheel and fan blade resistance mechanism with a user mounted on the machine.
Figure 24:
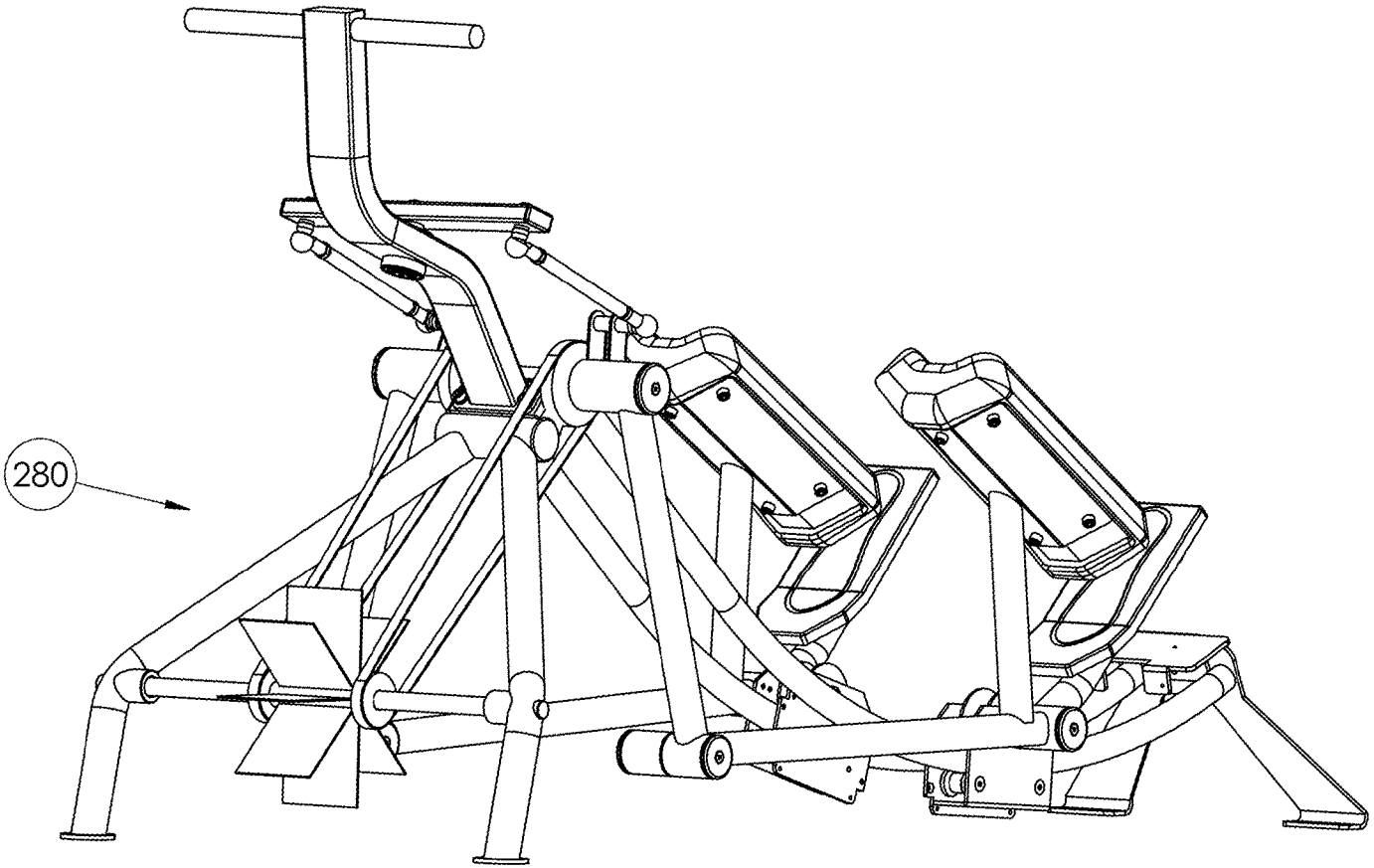
FIG. 24 is left side perspective view of the third embodiment of the invention with a flywheel and fan blade resistance mechanism.

FIGS. 23 and 24 illustrates machine 200 coupled with a fan blades resistance mechanism 280. The components of fan blades resistance mechanism 280 are identical to those of fan blades resistance mechanism 180 of machine 100 in structure and configuration as previously described herein. The only difference in the function of fan blades resistance mechanism 280 and fan blades resistance mechanism 180 of machine 100 is that the pivotal motion of left and right linkage connection hub pivots 291 are urged only by the motion of leg supports assembly 210.

A higher velocity of the exercise motion of machine 200 increases the resistance created by fan blades resistance mechanism 280. A lower velocity of the exercise motion of machine 200 decreases the resistance created by fan blades resistance mechanism 280.

While the invention has been described in connection with certain preferred embodiments, it is not intended to limit the spirit or scope of the invention to the particular forms set forth, but is intended to cover such alternatives, modifications, and equivalents as may be included within the true spirit and scope of the invention as defined by the appended claims.

REFERENCE NUMERALS

U User
1 Machine
5 Rear support frame
6 Forward support frame
10 Leg supports assembly
11 Shin pad
12 Shin pad support tube
13 Foot platform support tube
14 Foot platform
15 First leg support linkage bar
16 Leg support linkage bar pivot
17 Second leg support linkage bar
20 Magnetic resistance mechanism
21 Conductive blade
22A First magnets housing
22B Second magnets housing
23 Magnet
24 Conductive blades forward support bar
24A Conductive blades forward support bar upper pivot
24B Conductive blades forward support bar lower pivot
25 Conductive blades rear support bar
25A Conductive blades rear support bar upper pivot
25B Conductive blades rear support bar lower pivot
26 Conductive blades forward support bar mounting bracket
27 Conductive blades rear support bar mounting bracket
30 Wheel carriages assembly
31 Wheel carriage track
32 Wheel carriage housing
33 Upper carriage wheel
34 Lower carriage wheel
35 Upper carriage wheel axle
40 Resistance adjustment assembly
41 Resistance adjustment lever
42 Resistance adjustment lever pivot axle
43 Locking plate
44 Detent pin
45 Detent pin receiver hole
46 Resistance adjustment lever linkage bar pivot
47 Resistance adjustment lever linkage bar
48 Resistance adjustment lever handle
50 Rocker arm assembly
51 Rocker arm
52 Rocker arm support tube
53 Rocker arm linkage bar
54 Rocker arm left end linkage pivot
55 Rocker arm right end linkage pivot
56 Rocker arm pivot axle
60 Friction resistance assembly
61 Friction resistance plate
63 Friction resistance pads
64 Friction resistance plate forward support bar
65 Friction resistance plate rear support bar
70 Arm supports assembly
71 Lever
72 Handle
73 Lever mounting tube
74 Lever pivot
75 Lever linkage bar
76 Lever pivot axle
77 Lever linkage bar pivot
80 Fan blades resistance mechanism
81 Fan blades axle
83 Clutch bearing sprocket
84 Drive belt
85 Drive belt sprocket
86 Axle bearings
87 Fan Blade
90 Linkages connection hubs assembly
91 Linkages connection hub pivot
92 Linkages connection hub flange
93 Linkages connection hub flange rear pivot
94 Linkages connection hub flange forward pivot
100 Machine
105 Rear support frame
106 Forward support frame
110 Leg supports assembly
117 Second leg support linkage bar
120 Magnetic resistance mechanism
130 Wheel carriages assembly
140 Resistance adjustment assembly
150 Rocker arm assembly
160 Friction resistance mechanism
170 Arm supports assembly
171 Lever
172 Handle
180 Fan blades resistance mechanism
181 Fan blades axle
183 Clutch bearing sprocket
184 Drive belt
185 Drive belt sprocket
186 Axle bearings
187 Fan Blade
190 Linkage connection hub assembly
191 Linkage connection hub pivot
200 Machine
205 Rear support frame
206 Forward support frame
210 Leg supports assembly
220 Magnetic resistance mechanism
240 Resistance adjustment assembly
250 Rocker arm assembly
252 Rocker arm support tube
260 Friction resistance mechanism
270 Arm supports assembly
272 Stationary handle
273 Stationary handle support tube
280 Flywheel resistance mechanism
290 Linkage connection hub assembly

What is claimed is:

1. A crawling simulation exercise and stretching machine comprising:

a) a rear stationary support frame and a forward stationary support frame;

b) a left side horizontally oriented curved wheel track and a right side horizontally oriented curved wheel track each with a first end and a second end, wherein the first ends are connected to the rear stationary support frame and the second ends are connected to the forward stationary support frame;

c) a left wheel carriage rollably engaged with the left side horizontally oriented curved wheel track and a right wheel carriage rollably engaged with the right side horizontally oriented curved wheel track;

d) an elongated rocker arm with a left end, a right end, and a central axle that is pivotally mounted on the forward stationary support frame;

e) a left side linkages connection hub pivotably mounted on the forward stationary support frame and a right side linkages connection hub pivotably mounted on the forward stationary support frame;

f) a left side lever being vertically oriented and having a lower end that is pivotally mounted on the forward stationary support frame and an upper end comprising a first handle, and a right side lever being vertically oriented and having a lower end that is pivotally mounted on the forward stationary support frame and an upper end comprising a second handle;

g) first and second left side linkage bars, wherein a first end of the first left side linkage bar is pivotally connected to the left wheel carriage and a second end of the first left side linkage bar is pivotally connected to a first end of the second left side linkage bar, and a second end of the second left side linkage bar is connected to the left side linkages connection hub;

h) first and second right side linkage bars, wherein a first end of the first right side linkage bar is pivotally connected to the right wheel carriage and a second end of the first right side linkage bar is pivotally connected to a first end of the second right side linkage bar, and a second end of the second right side linkage bar is connected to the right side linkages connection hub;

i) a left side foot platform and shin support pad connected to the first end of the first left side linkage bar and a right side foot platform and shin support pad connected to the first end of the first right side linkage bar;

j) a third left side linkage bar, wherein a first end of the third left side linkage bar is connected to the left side linkages connection hub and a second end of the third left side linkage bar is connected to the left end of the elongated rocker arm, and a third right side linkage bar, wherein a first end of the third right side linkage bar is connected to the right side linkages connection hub and a second end of the third right side linkage bar is connected to the right end of the elongated rocker arm; and k) a fourth left side linkage bar, wherein a first end of the fourth left side linkage bar is connected to the left side lever and a second end of the fourth left side linkage bar is connected to the left side linkages connection hub, and a fourth right side linkage bar, wherein a first end of the fourth right side linkage bar is connected to the right side lever and a second end of the fourth right side linkage bar is connected to the right side linkages connection hub, wherein the elongated rocker arm is constructed so as to synchronize and control motions of the left side lever, the right side lever, the left side foot platform and shin support pad, and the right side foot platform and shin support pad such that the left side lever and the left side foot platform and shin support pad move in opposite directions from each other and the right side lever and the right side foot platform and shin support pad move in opposite directions from each other during operation of the crawling simulation exercise and stretching machine.

2. The machine of claim 1, wherein the left side lever, the right side lever, the left side foot platform and shin support pad, and the right side foot platform and shin support pad all move in reciprocating arcing patterns of motion of less than 180 degrees.

3. The machine of claim 2, wherein the reciprocating arcing patterns of motion of the left side lever, the right side lever, the left side foot platform and shin support pad, and the right side foot platform and shin support pad are all controlled by mechanical components of the machine, and a range of movement of the reciprocating arcing patterns of motion of the left side lever, the right side lever, the left side foot platform and shin support pad, and the right side foot platform and shin support pad are all controllable by a range of movement of an exercise motion of a user of the machine.

4. The machine of claim 3, further comprising a resistance mechanism operatively connected to the movement of the left side lever, the right side lever, the left side foot platform and shin support pad, and the right side foot platform and shin support pad.

5. The machine of claim 4, wherein the resistance mechanism creates a magnetic resistance that is adjustable to a plurality of amounts of magnetic resistance, and at each of the plurality of amounts of magnetic resistance, the amount of magnetic resistance is constant through an entire range of movement of the left side lever, the right side lever, the left side foot platform and shin support pad, and the right side foot platform and shin support pad.

6. The machine of claim 4, wherein the resistance mechanism creates a contact friction resistance that is adjustable to a plurality of amounts of contact friction resistance, and at each of the plurality of amounts of contact friction resistance, the amount of contact friction resistance is constant through an entire range of movement of the left side lever, the right side lever, the left side foot platform and shin support pad, and the right side foot platform and shin support pad.

7. The machine of claim 4, wherein the resistance mechanism creates air displacement resistance.

8. A crawling simulation exercise and stretching machine comprising:

a) a rear stationary support frame and a forward stationary support frame;

b) a left side horizontally oriented curved wheel track and a right side horizontally oriented curved wheel track each with a first end and a second end, wherein the first ends are connected to the rear stationary support frame and the second ends are connected to the forward stationary support frame;

c) a left wheel carriage rollably engaged with the left side horizontally oriented curved wheel track and a right wheel carriage rollably engaged with the right side horizontally oriented curved wheel track;

d) an elongated rocker arm with a left end, a right end, and a central axle that is pivotally mounted on the forward stationary support frame;

e) a left side linkages connection hub pivotably mounted on the forward stationary support frame and a right side linkages connection hub pivotably mounted on the forward stationary support frame;

f) a left side lever being vertically oriented and having a lower end that is rigidly connected to the left side linkages connection hub and an upper end comprising a first handle, and a right side lever being vertically oriented and having a lower end that is rigidly connected to the right side linkages connection hub and an upper end comprising a second handle;

g) first and second left side linkage bars, wherein a first end of the first left side linkage bar is pivotally connected to the left wheel carriage and a second end of the first left side linkage bar is pivotally connected to a first end of the second left side linkage bar and a second end of the second left side linkage bar is connected to the left side linkages connection hub;

h) first and second right side linkage bars, wherein a first end of the first right side linkage bar is pivotally connected to the right wheel carriage and a second end of the first right side linkage bar is pivotally connected to a first end of the second right side linkage bar and a second end of the second right side linkage bar is connected to the right side linkages connection hub;

i) a left side foot platform and shin support pad connected to the first end of the first left side linkage bar and a right side foot platform and shin support pad connected to the first end of the first right side linkage bar;

j) a third left side linkage bar, wherein a first end of the third left side linkage bar is connected to the left side linkages connection hub and a second end of the third left side linkage bar is connected to the left end of the elongated rocker arm, and a third right side linkage bar wherein a first end of the third right side linkage bar is connected to the right side linkages connection hub and a second end of the third right side linkage bar is connected to the right end of the elongated rocker arm, wherein the elongated rocker arm is structured to synchronize and control motions of the left side lever, the right side lever, the left side foot platform and shin support pad, and the right side foot platform and shin support pad such that the left side lever and the left side foot platform and shin support pad move in opposite directions from each other and the right side lever and the right side foot platform and shin support pad move in opposite directions from each other during operation of the crawling simulation exercise and stretching machine.

9. The machine of claim 8, wherein the left side lever, the right side lever, the left side foot platform and shin support pad, and the right side foot platform and shin support pad all move in reciprocating arcing patterns of motion of less than 180 degrees.

10. The machine of claim 9, wherein the reciprocating arcing patterns of motion of the left side lever, the right side lever, the left side foot platform and shin support pad, and the right side foot platform and shin support pad are all controlled by mechanical components of the machine, and a range of movement of the reciprocating arcing patterns of motion of the left side lever, the right side lever, the left side foot platform and shin support pad, and the right side foot platform and shin support pad are all controllable by a range of movement of an exercise motion of a user.

11. The machine of claim 10, further comprising a resistance mechanism operatively connected to the left side lever, the right side lever, the left side foot platform and shin support pad, and the right side foot platform and shin support pad.

12. The machine of claim 11, wherein the resistance mechanism creates a magnetic resistance that is adjustable to a plurality of amounts of magnetic resistance and at each of the plurality of amounts of magnetic resistance, the amount of magnetic resistance is constant through an entire range of movement of the left side lever, the right side lever, the left side foot platform and shin support pad, and the right side foot platform and shin support pad.

13. The machine of claim 11, wherein the resistance mechanism creates contact friction resistance that is adjustable to a plurality of amounts of contact friction resistance and at each of the plurality of amounts of contact friction resistance, the amount of contact friction resistance is constant through an entire range of movement of the left side lever, the right side lever, the left side foot platform and shin support pad, and the right side foot platform and shin support pad.

14. The machine of claim 11, wherein the resistance mechanism creates air displacement resistance.

15. A crawling simulation exercise and stretching machine comprising:

a) a rear stationary support frame and a forward stationary support frame;

b) a left side horizontally oriented curved wheel track and a right side horizontally oriented curved wheel track each with a first end and a second end, wherein the first ends are connected to the rear stationary support frame and the second ends are connected to the forward stationary support frame;

c) a left wheel carriage rollably engaged with the left side horizontally oriented curved wheel track and a right wheel carriage rollably engaged with the right side horizontally oriented curved wheel track;

d) an elongated rocker arm with a left end, a right end, and a central axle that is pivotally mounted on the forward stationary support frame;

e) a left side linkage connection hub pivotably mounted on the forward stationary support frame and a right side linkage connection hub pivotably mounted on the forward stationary support frame;

f) first and second left side linkage bars, wherein a first end of the first left side linkage bar is pivotally connected to the left wheel carriage and a second end of the first left side linkage bar is pivotally connected to a first end of the second left side linkage bar and a second end of the second left side linkage bar is connected to the left side linkage connection hub;

g) first and second right side linkage bars, wherein a first end of the first right side linkage bar is pivotally connected to the right wheel carriage and a second end of the first right side linkage bar is pivotally connected to a first end of the second right side linkage bar and a second end of the second right side linkage bar is connected to the right side linkage connection hub;

h) a left side foot platform and shin support pad connected to the first end of the first left side linkage bar and a right side foot platform and shin support pad connected to the first end of the first right side linkage bar;

i) a third left side linkage bar, wherein a first end of the third left side linkage bar is connected to the left side linkage connection hub and a second end of the third left side linkage bar is connected to the left end of the elongated rocker arm, and a third right side linkage bar, wherein a first end of the third right side linkage bar is connected to the right side linkage connection hub and a second end of the third right side linkage bar is connected to the right end of the elongated rocker arm, wherein the elongated rocker arm is structured so as to synchronize and control motions of the left side foot platform and shin support pad and the right side foot platform and shin support pad such that the left side foot platform and shin support pad and the right side foot platform and shin support pad move in opposite directions from each other during operation of the crawling simulation exercise and stretching machine.

16. The machine of claim 15, wherein the left side foot platform and shin support pad and the right side foot platform and shin support pad move in reciprocating arcing patterns of motion of less than 180 degrees.

17. The machine of claim 16, wherein the reciprocating arcing patterns of motion of the left side foot platform and shin support pad and the right side foot platform and shin support pad are all controlled by mechanical components of the machine, and a range of movement of the reciprocating arcing patterns of motion of the left side foot platform and shin support pad and the right side foot platform and shin support pad are controllable by a range of movement of an exercise motion of a user.

18. The machine of claim 17, further comprising a resistance mechanism operatively connected to the movement of the left side foot platform and shin support pad and the right side foot platform and shin support pad.

19. The machine of claim 18, wherein the resistance mechanism creates a magnetic resistance that is adjustable to a plurality of amounts of magnetic resistance and at each of the plurality of amounts of magnetic resistance, the amount of magnetic resistance is constant through an entire range of movement of the left side foot platform and shin support pad and the right side foot platform and shin support pad.

20. The machine of claim 18, wherein the resistance mechanism creates contact friction resistance that is adjustable to a plurality of amounts of contact friction resistance and at each of the plurality of amounts of contact friction resistance, the amount of contact friction resistance is constant through an entire range of movement of the left side foot platform and shin support pad and the right side foot platform and shin support pad.

21. The machine of claim 18, wherein the resistance mechanism creates air displacement resistance.

* * * * *